US007997523B1

(12) United States Patent
Taugner

(10) Patent No.: US 7,997,523 B1
(45) Date of Patent: Aug. 16, 2011

(54) TURNTABLE (WITH ATTACHMENTS) FOR THE DISPENSING OF ELECTRICAL WIRE, CABLE OR OTHER LINEAR GOODS THAT ARE SUPPLIED ON REELS OR IN COILS, DEPENDING ON THE ATTACHMENT USED

(76) Inventor: John Charles Taugner, Fairfax, VA (US)

( * ) Notice: Subject to any disclaimer, the term of this patent is extended or adjusted under 35 U.S.C. 154(b) by 0 days.

(21) Appl. No.: 12/699,026

(22) Filed: Feb. 2, 2010

Related U.S. Application Data

(60) Provisional application No. 61/149,165, filed on Feb. 2, 2009.

(51) Int. Cl.
*B65H 16/04* (2006.01)

(52) U.S. Cl. ..... 242/597.7; 242/406; 242/597.5

(58) Field of Classification Search ..... 242/597, 242/597.1–597.8, 406
See application file for complete search history.

(56) References Cited

U.S. PATENT DOCUMENTS

| | | | | |
|---|---|---|---|---|
| 2,300,869 | A * | 11/1942 | Brandes, Jr. | 242/575.5 |
| 2,580,129 | A | 12/1951 | Rich | |
| 5,516,059 | A | 5/1996 | Gudgeon et al. | |
| 5,810,283 | A | 9/1998 | Shea | |
| 5,895,197 | A | 4/1999 | McVaugh | |
| 5,897,073 | A | 4/1999 | McVaugh | |
| 6,056,226 | A | 5/2000 | Green | |
| 6,079,662 | A | 6/2000 | Miller et al. | |
| 6,212,917 | B1 * | 4/2001 | Rathbun | 68/212 |
| 6,241,181 | B1 | 6/2001 | Campbell | |
| 6,481,661 | B1 | 11/2002 | Lauhde | |
| 6,527,220 | B2 | 3/2003 | Weaver et al. | |
| 6,722,607 | B2 | 4/2004 | Weaver et al. | |
| 7,007,885 | B2 | 3/2006 | Buckwitz | |
| 7,017,742 | B2 | 3/2006 | Dragoo et al. | |
| 7,017,848 | B2 | 3/2006 | Fleming | |
| 7,364,109 | B2 | 4/2008 | Kuo | |
| 7,448,570 | B2 * | 11/2008 | Bohnisch | 242/578 |
| 2001/0035473 | A1 * | 11/2001 | Patton | 242/397.2 |
| 2005/0253015 | A1 | 11/2005 | Bohnisch | |
| 2009/0008492 | A1 | 1/2009 | Phillips | |

FOREIGN PATENT DOCUMENTS

| | | |
|---|---|---|
| DE | 2714328 | 10/1977 |

* cited by examiner

*Primary Examiner* — Sang Kim
(74) *Attorney, Agent, or Firm* — Swift Law Office; Stephen Christopher Swift

(57) ABSTRACT

A dispenser for spools, reels or coils of electrical wire or cable, or other linear products, such as rope, twine, string, fishing line, etc. It comprises a turntable, a central inner spindle, and various attachments. The attachments can be placed on the floor, and then selected attachments can be fitted to the inner spindle. Attachments are selected based on the size of the spool, reel or coil of wire or cable. The attachments include a small pipe spindle for use with smaller spools, a large pipe spindle for use with larger spools or reels, and a coil clamp assembly use with for coils. The wire or cable can pay out in all horizontal directions from the invention. If more wire or cable is pulled out than is needed, the excess can be rewound and will return to the dispenser with the aid of a sloped outer edge of the turntable.

9 Claims, 42 Drawing Sheets

TURNTABLE ONLY (NO ATTACHMENTS)

COIL OF COMMERCIAL CABLE (BX)
WITH COIL CLAMP ATTACHMENT

COIL OF RESIDENTIAL CABLE (RX)
WITH COIL CLAMP ATTACHMENT

SMALL SPOOLS OF WIRE
WITH SMALL SPINDLE ATTACHMENT

LARGE REEL OF CABLE
WITH LARGE SPINDLE ATTACHMENT

TURNTABLE (WITH ATTACHMENTS) FOR THE DISPENSING OF ELECTRICAL WIRE, CABLE OR OTHER LINEAR GOODS THAT ARE SUPPLIED ON REELS OR IN COILS, DEPENDING ON THE ATTACHMENT USED

CROSS REFERENCE TO RELATED APPLICATION

This application is based on and claims the benefit of Provisional Patent Application Ser. No. 61/149,165, filed Feb. 2, 2009, which is incorporated herein by reference. A separate letter, entitled "Disclosure Document Reference", was filed on Feb. 2, 2009 in said Provisional Patent Application Ser. No. 61/149,165, for Disclosure Document No. 612431, that was received in the United States Patent and Trademark Office on Jan. 31, 2007, for the invention that is described and claimed in this application, entitled "'CABLE TABLE' Dispenser for wire & cable on spools-reels-coils". (Please note that as Jan. 31, 2009 was a Saturday, the deadline for filing said separate letter was Monday, Feb. 2, 2009, under 35 U.S.C. 21(b).)

BACKGROUND OF THE INVENTION

1. Field of the Invention

The present invention relates to dispensers for cable, wire and other linear products. The present invention is designed for use by electricians, but it may be useful to others.

2. Description of the Prior Art

Electrical wire and cable is supplied for installation by electricians primarily in the following modes:

Spools—a seven inch diameter is common.

Reels—large spools, for which a four foot diameter is common.

Coils—Residential (RX)—two to eight inches in height.

Coils—Commercial (CX)—six to eight inches in height.

There are many different dispensers available for each of these different modes. The present invention provides a single dispenser that can be used for all four of these common modes.

There have been many previous inventions for dispensing linear products, but none that are equivalent to the present invention.

U.S. Pat. No. 2,580,129, issued on Dec. 25, 1951, to Charles C. Rich, discloses a twine dispenser having a spring that presses a spool of twine down against a turntable. The instant invention is distinguishable, in that it uses a turntable with sloping sides.

U.S. Pat. No. 5,516,059, issued on May 14, 1996, to Thomas A. Gudgeon and John Trinity, discloses an electrical wire spool guide, with adjustable side plates and an adjustable spacer. The instant invention is distinguishable, in that only it uses pipe spindles with setscrews or a spring-loaded pressure plate.

U.S. Pat. No. 5,810,283, issued on Sep. 22, 1998, to Patrick Joseph Shea, discloses an apparatus and method for wire coil payoff, in which the wire is dispensed through an eyelet in a shroud covering the coil. The instant invention is distinguishable, in that it permits the wire to be paid off in any horizontal direction.

U.S. Pat. No. 5,895,197, issued on Apr. 20, 1999, to Arthur Kenneth McVaugh, discloses a cable reel handler for mounting at the rear of a truck for loading and unloading of cable reels. Again, the instant invention is distinguishable, in that only it uses pipe spindles with setscrews or a spring-loaded pressure plate.

U.S. Pat. No. 5,897,073, issued on Apr. 27, 1999, to Arthur K. McVaugh, discloses a reel handler, in which the reel is rotated by an hydraulic motor. The instant invention is distinguishable, in that it is designed to be turned by hand.

U.S. Pat. No. 6,056,226, issued on May 2, 2000, to Robert L. Green, discloses a caddy for electrical extension cords, including a cylindrical container from which the cord is unwound using a hand crank and passes through an opening in the container. It does not disclose the use of pipe spindles with setscrews or a spring-loaded pressure plate, as in the instant invention.

U.S. Pat. No. 6,079,662, issued on Jun. 27, 2000, to William C. Miller, discloses an expansible core shaft assembly for retaining spool cores in axially fixed positions, while permitting rotational slipping of the spool cores. Again, it does not disclose the use of pipe spindles with setscrews or a spring-loaded pressure plate, as in the instant invention.

U.S. Pat. No. 6,241,181, issued on Jun. 5, 2001, to William F. Campbell, discloses a reusable wire distribution spool, with two halves, each having an end plate and a central mandrel.

U.S. Pat. No. 6,481,661, issued on Nov. 19, 2002, to Mika Lauhde, discloses an arrangement for winding cables on and off a reel with a central hole.

U.S. Pat. No. 6,527,220, issued on Mar. 4, 2003, and U.S. Pat. No. 6,722,607, issued on Apr. 20, 2004, both to Dustin H. Weaver and Thomas L. Yoast, disclose a knockdown changeable reel system and method.

U.S. Pat. No. 7,007,885, issued on Mar. 7, 2006, to Richard J. Buckwitz, discloses a wire segment reel assembly and method, including a reel having a magnetic rim, turntable, magnetic key, and a wire feed tube. The instant invention is distinguishable, in that it does not require any magnetic parts.

U.S. Pat. No. 7,017,742, issued on Mar. 28, 2006, to Robert K. Dragoo, David E. Shepard and Michael A. Rowland, discloses a cylindrical container for storing material such as welding wire, from which it can be unwound.

U.S. Pat. No. 7,017,848, issued on Mar. 28, 2006, to Thomas William Fleming, discloses a hand-held cable reel, comprising a central cable receiving core mounted between a pair of disc-like end flanges.

U.S. Pat. No. 7,364,109, issued on Apr. 29, 2008, to Chin-Chang Kuo, discloses a cable reel with a turntable that can rewind the cable with the aid a volute spring not required in the instant invention.

U.S. Patent Application Publication No. 2005/0253015, published on Nov. 17, 2005, to Rudolf Bohnisch, discloses an unwinding apparatus for reeling off coiled material.

U.S. Patent Application Publication No. 2009/0008492, published on Jan. 8, 2009, to David E. Phillips, discloses a wire caddy designed to hold single or multiple spools of electrical wire used in the building trades. It does not disclose a turntable with rounded edges or the spring-loaded clamping mechanism of the instant invention.

German Patent No. 27 14 328, published on Oct. 27, 1977, inventor Antonio Macchi Cassia, discloses a serviette dispenser with a winding drum that may be mounted on a vertical spindle with a coil spring.

None of the above inventions and patents, taken either singly or in combination, is seen to describe the instant invention as claimed.

SUMMARY OF THE INVENTION

The present invention is a dispenser for spools, reels or coils of electrical wire or cable. It may also be used for other linear products, such as rope, twine, string, fishing line, etc. It comprises a turntable, a central inner spindle, and various attachments. The attachments can be placed on the floor, and then selected attachments can be fitted to the inner spindle. Attachments are selected based on the size of the spool, reel or coil of wire or cable. The attachments include a small pipe spindle for use with smaller spools, a large pipe spindle for use with larger spools or reels, and a coil clamp assembly for use with coils. The wire or cable can pay out in all horizontal directions from the invention. If more wire or cable is pulled out than is needed, the excess can be rewound and will return to the dispenser with the aid of a sloped outer edge of the turntable. The coil clamp assembly includes a hub, a pressure plate that is placed over and holds down the coil, and three springs with T-shaped handles for holding down the pressure plate. The pressure plate has three inward metal extensions or spring holds, with holes through which shafts extending from the handles may be inserted. The spring holds may be retained between coils in the springs. The handles can be raised to release the pressure plate. One edge of the spring holds may be filed to facilitate insertion and removal of the springs.

Accordingly, it is a principal object of the invention to provide a means for dispensing a variety of linear products.

It is another object of the invention to make it easier to rewind spools, reels or coils, without the need for a brake in the dispenser.

It is a further object of the invention to provide a means for attaching a variety of spindles to a turntable.

Still another object of the invention is to provide a means for utilizing the power of coil springs to retain linear products.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
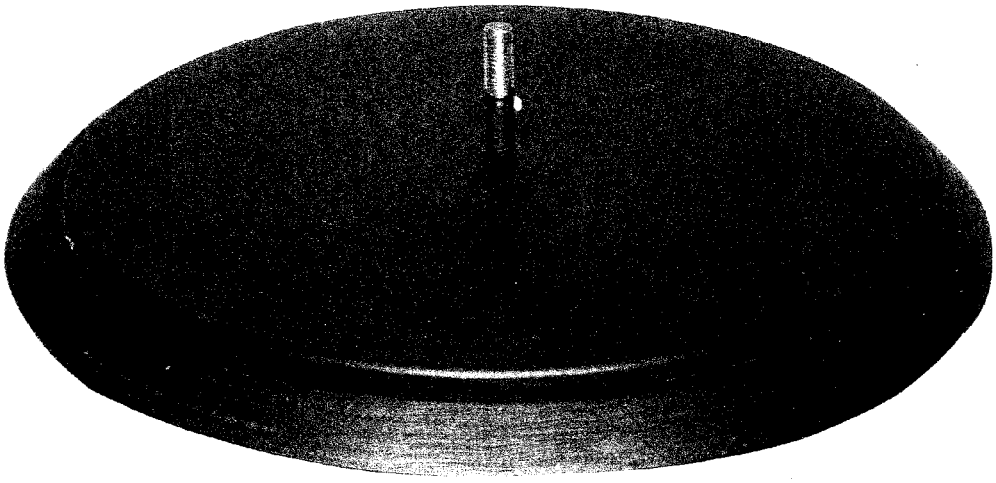
FIG. 1 is a photograph of the turntable of the preferred embodiment of the invention, with no attachments.

The present invention a turntable dispenser for wire, cable, rope, and other linear products, with a set of three attachments, namely, a small spindle, a large spindle, and a clamping assembly.

The following items are referenced in the drawings:

In the Turntable Assembly:

1. turntable base
2. sloped side of turntable base
3. lower ball bearing race
4. ball bearings
5. seal to keep dirt from ball bearings
6. threaded hole for bolt 11
7. turntable
8. rounded edge
9. threaded hole for attachments
10. upper ball bearing race
11. bolt to secure turntable 7 to base 1
12. inner spindle
13. threads at bottom of inner spindle that engage threads in hole 9
14. first set screw to secure small outer spindle 16
15. threads to accept threads 21 of part 20

In the Small Spindle Assembly:

16. small outer spindle for small spools
17. first transverse hole for set screw 14
18. spool retainer to prevent spools from sliding up
19. third set screw to retain 18 to 16

In the Large Spindle Assembly:

20. attachment connector
21. threads to engage threads 15
22. second set screw to secure large outer spindle 23
23. large outer spindle for large reels
24. second transverse hole for set screw 22

In the Coil Clamp Assembly:

25. hub base
26. center hole for hub attachment to turntable
27. slots to receive and retain springs
28. springs
29. T-shaped spring handle
30. slip bushing
31. shaft of spring handle that secures spring 38 to hub base
32. coil hub
33. hub slots to receive spring holders 39
34. holes to secure hub 32 to base 25
35. screw to secure hub 32 to base 25
36. pressure plate
37. inner edge of pressure plate
38. outer edge of pressure plate
39. spring holds
40. receiving ends of spring holds
41. spring lock-in hole to receive shaft of spring handle
42. bolts to retain spring holders 39 on pressure plate 36

Figure 2:
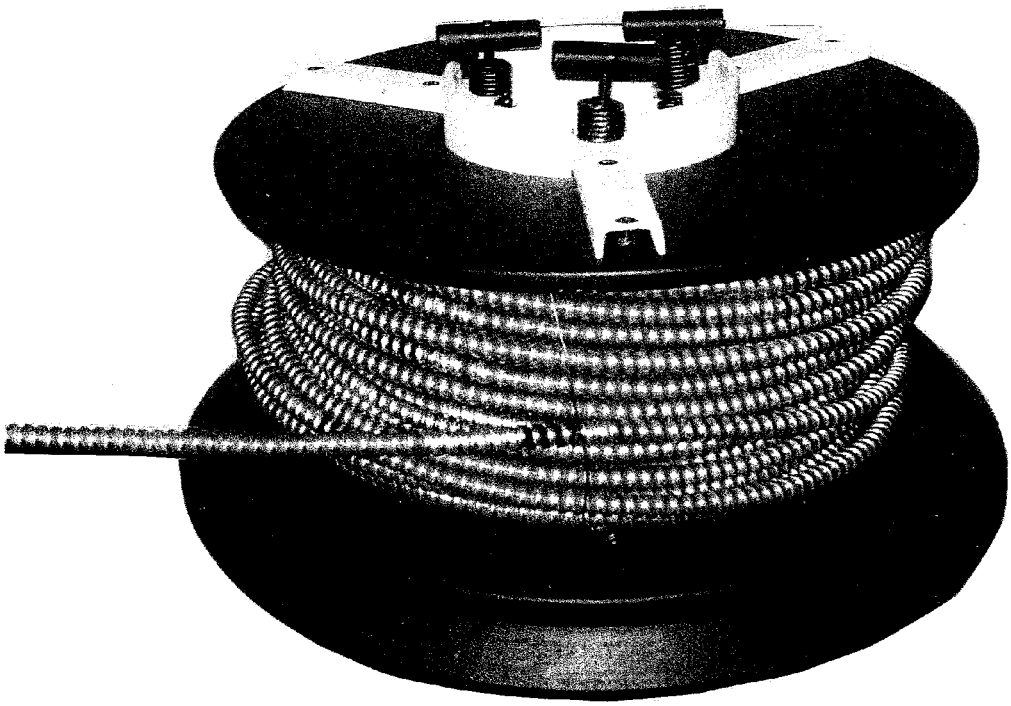
FIG. 2 is a photograph showing a coil of BX commercial cable lying on the turntable, retained by the coil clamp attachment of the preferred embodiment of the invention.
Figure 3:
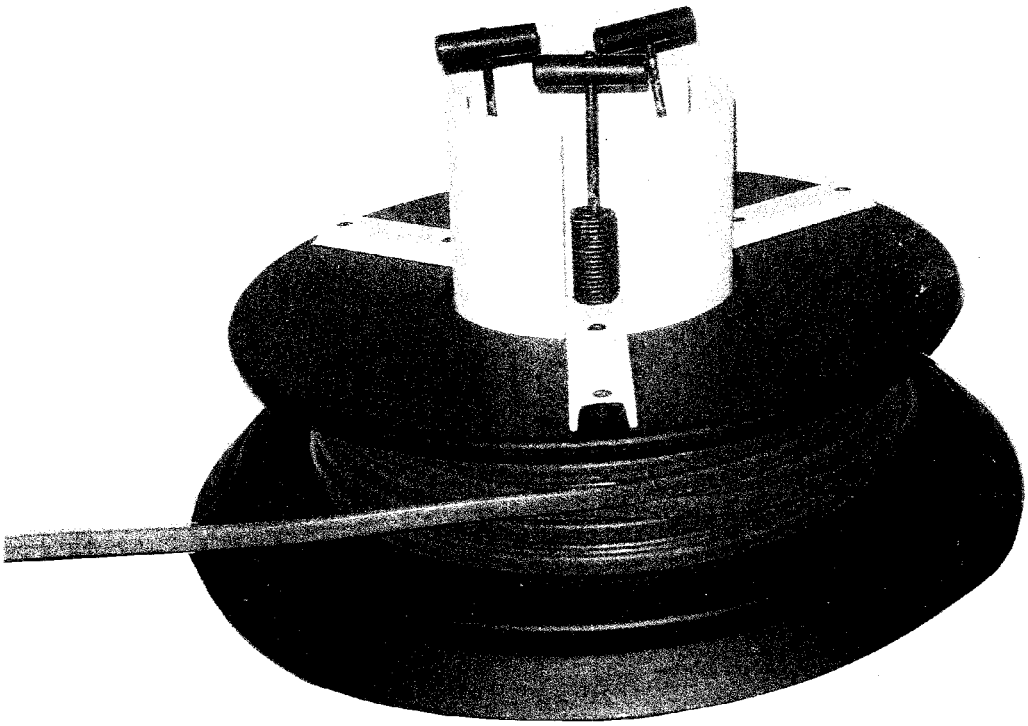
FIG. 3 is a photograph showing a coil of RX residential cable lying on the turntable, retained by the coil clamp attachment of the preferred embodiment of the invention.
Figure 4:
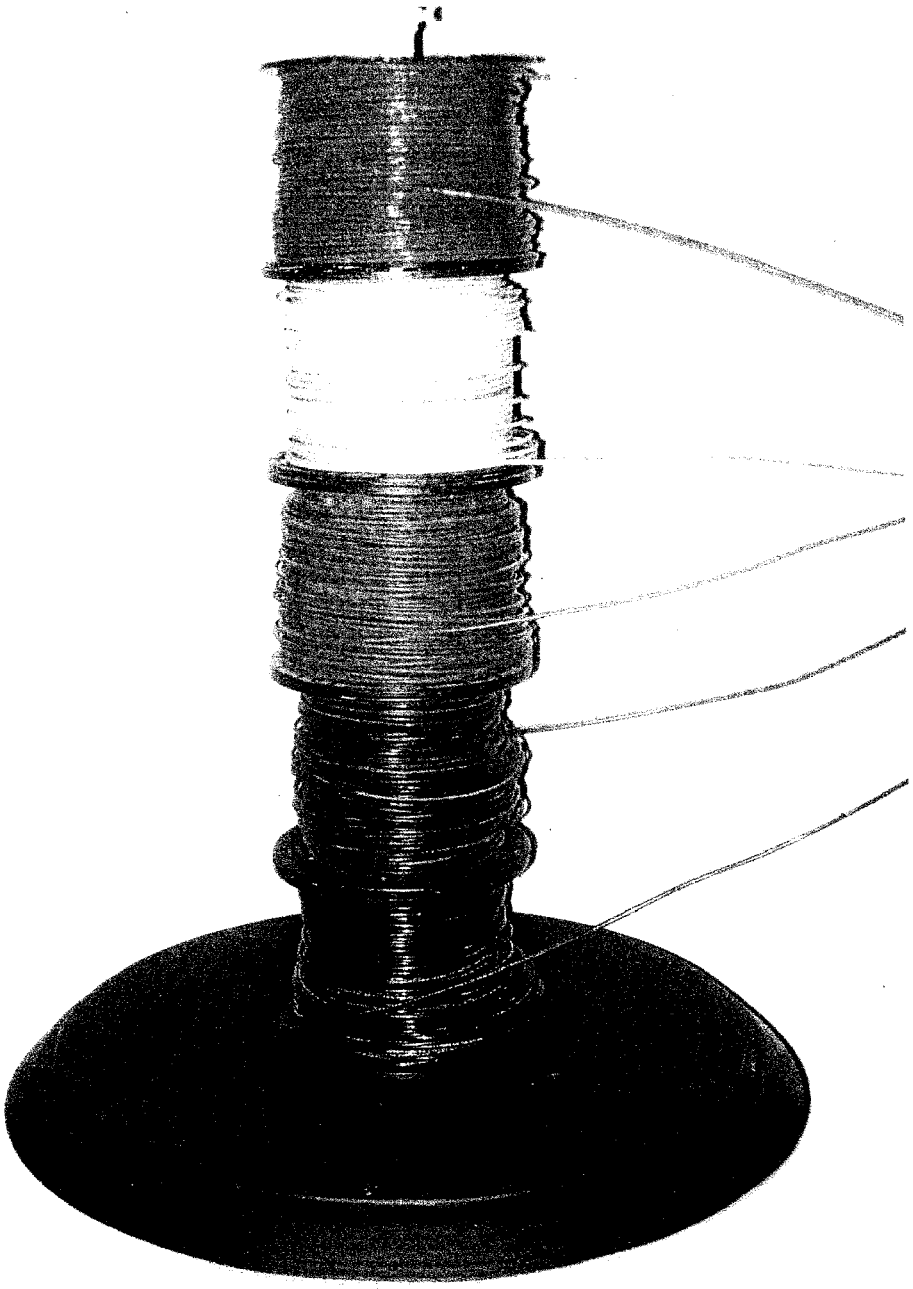
FIG. 4 is a photograph showing small spools of wire stacked on the turntable, retained by the small spindle attachment of the preferred embodiment of the invention.
Figure 5:
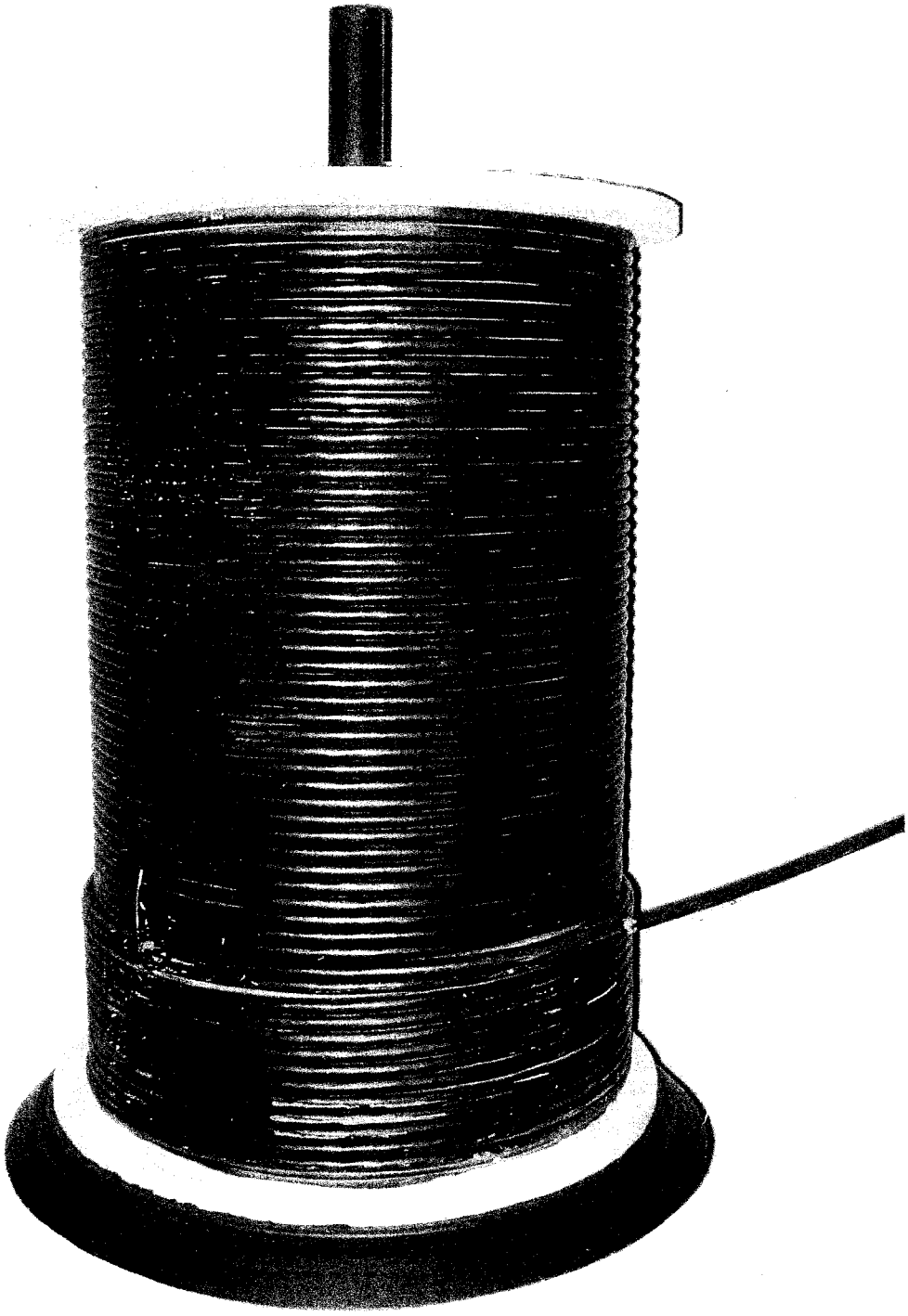
FIG. 5 is a photograph showing a large reel of cable lying on the turntable, retained by the large spindle attachment of the preferred embodiment of the invention.

FIG. 1 is a photograph of the turntable of the preferred embodiment of the invention, with no attachments. FIG. 2 is a photograph showing a coil of BX commercial cable lying on the turntable, retained by the coil clamp attachment of the preferred embodiment of the invention. FIG. 3 is a photograph showing a coil of RX residential cable lying on the turntable, retained by the coil clamp attachment of the preferred embodiment of the invention. FIG. 4 is a photograph showing small spools of wire stacked on the turntable, retained by the small spindle attachment of the preferred embodiment of the invention. FIG. 5 is a photograph showing a large reel of cable lying on the turntable, retained by the large spindle attachment of the preferred embodiment of the invention.

Figure 6:
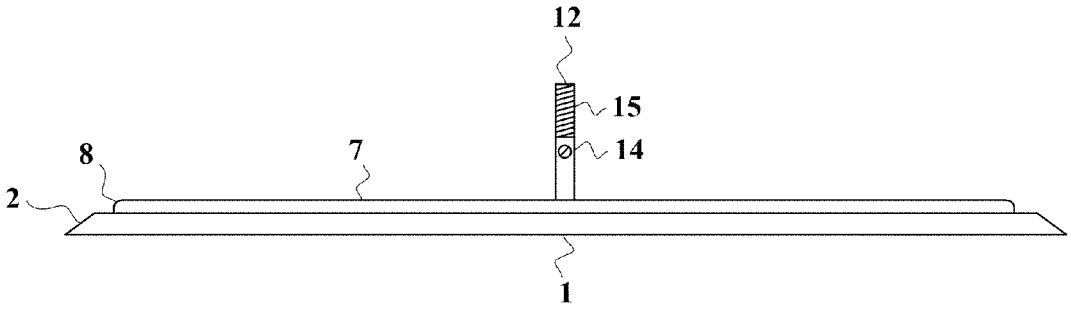
FIG. 6 is a front elevational view of the turntable of the preferred embodiment of the invention, with no attachments.
Figure 7:
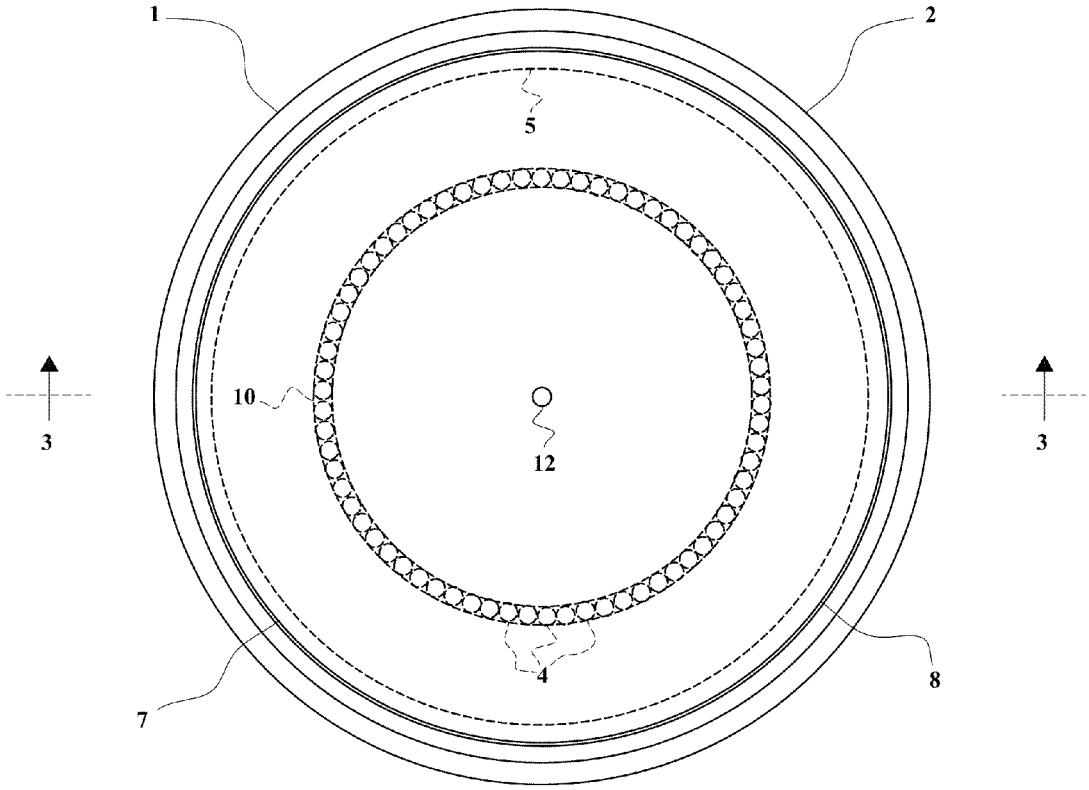
FIG. 7 is a top plan view of the turntable of the preferred embodiment of the invention, with no attachments.
Figure 8:
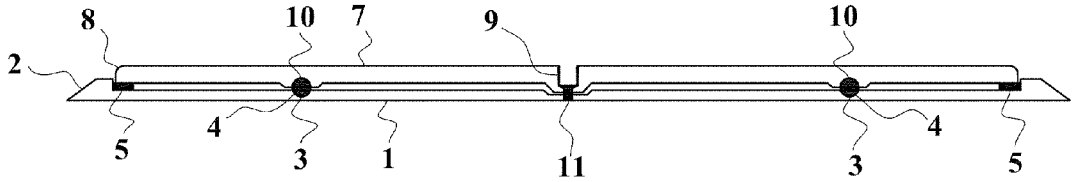
FIG. 8 is a sectional view of the turntable of the preferred embodiment of the invention, drawn along lines 3-3 of FIG. 7.
Figure 9:
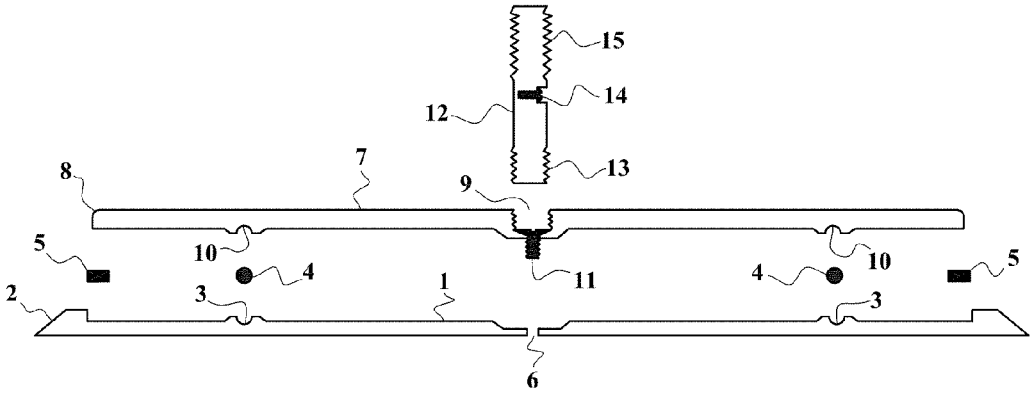
FIG. 9 is an exploded sectional view of the turntable of the preferred embodiment of the invention, drawn along lines 3-3 of FIG. 7.

FIG. 6 is a front elevational view of the turntable of the preferred embodiment of the invention, with no attachments, showing the circular turntable base 1 with sloped side 2 along its circumference. The turntable 7 rests in the base, and has a rounded edge 8. The sloped side of the base and rounded edge of the turntable make is easy to manually rewind linear products on the floor. The inner spindle 12 extends upwards from the center of the turntable, and has first set screw 14 and screw threads 15 at its upper end. FIG. 7 is a top plan view of the turntable of the preferred embodiment of the invention, with no attachments. FIG. 8 is a sectional view of the turntable of the preferred embodiment of the invention, drawn along lines 3-3 of FIG. 7, showing ball bearings 4 retained between a lower race 3 on the bottom of the turntable and an upper race 10 on the top of the base, seal 5 to keep dirt from the ball bearings, bolt 11 to secure the turntable to the base, and the hole 9 with threads that can engage threads 13 at the bottom of the inner spindle to removably retain the inner spindle in the center of the turntable. FIG. 9 is an exploded sectional view of the turntable of the preferred embodiment of the invention, drawn along lines 3-3 of FIG. 7.

Figure 10:
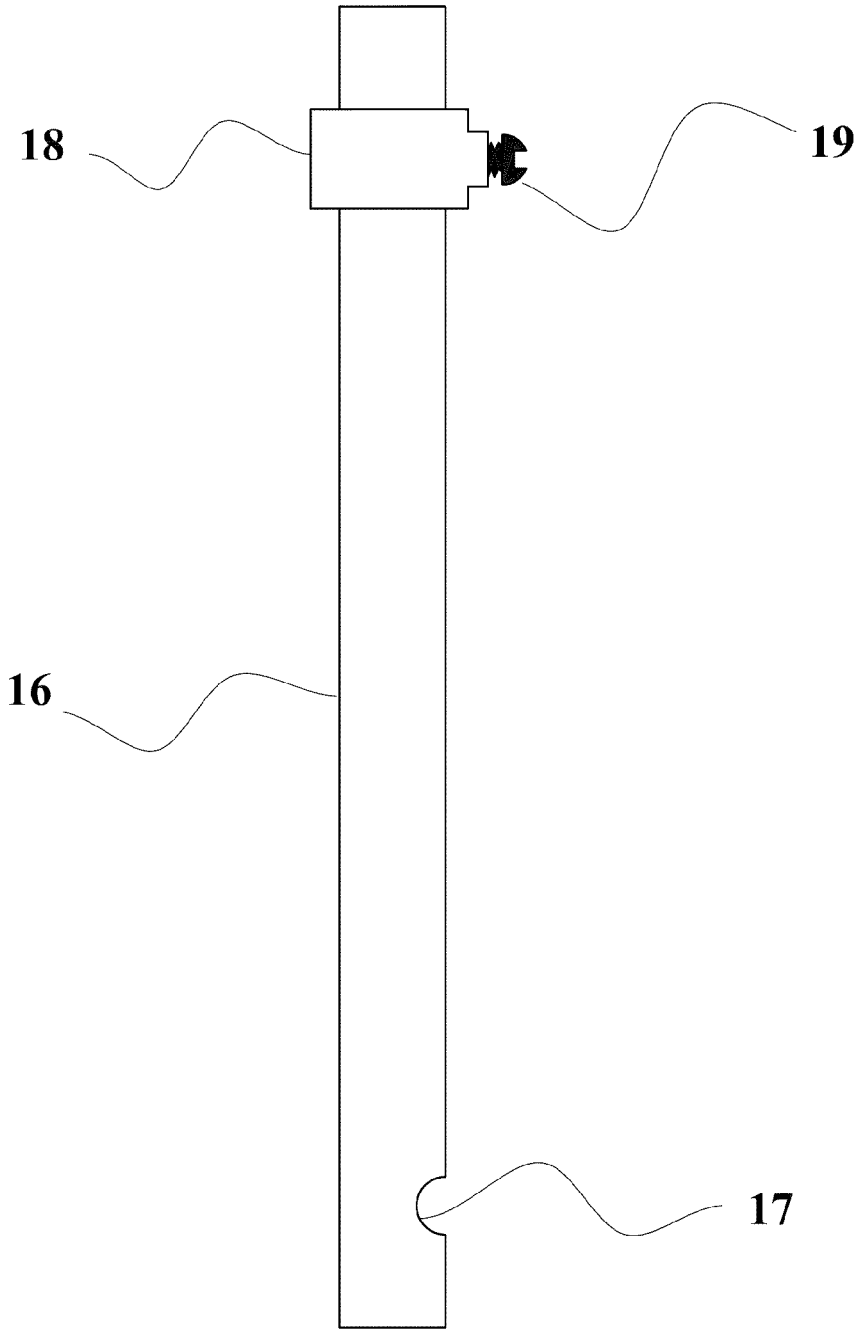
FIG. 10 is a front elevational view of the small spindle of the preferred embodiment of the invention.
Figure 11:
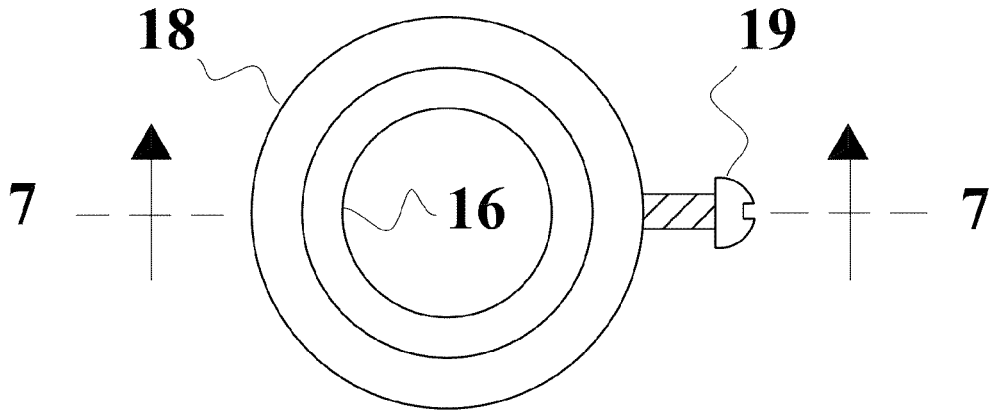
FIG. 11 is a top plan view of the small spindle of the preferred embodiment of the invention.
Figure 12:
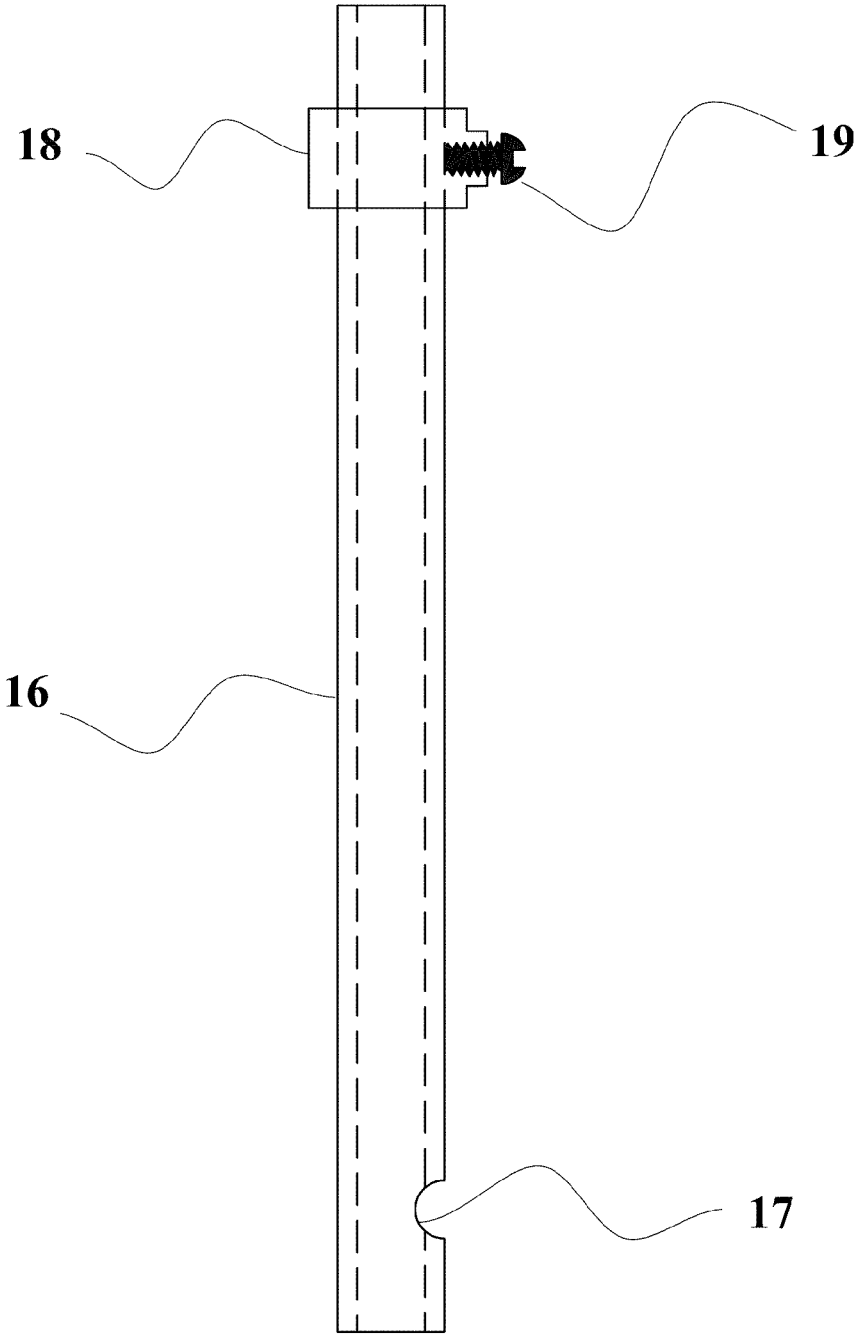
FIG. 12 is a sectional view of the small spindle of the preferred embodiment of the invention, drawn along lines 7-7 of FIG. 11.
Figure 13:
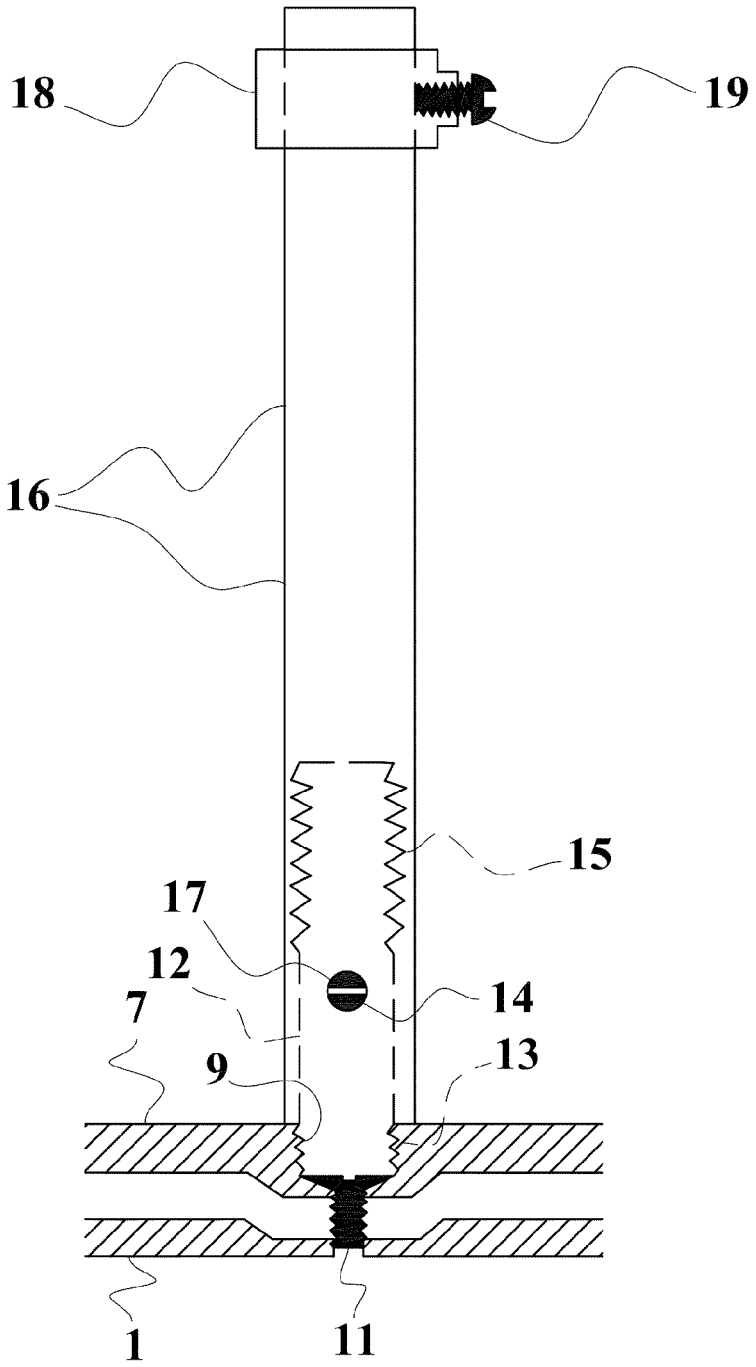
FIG. 13 is a detail sectional view of the small spindle combined with the turntable of the preferred embodiment of the invention, drawn along lines 7-7 of FIG. 11.
Figure 14:
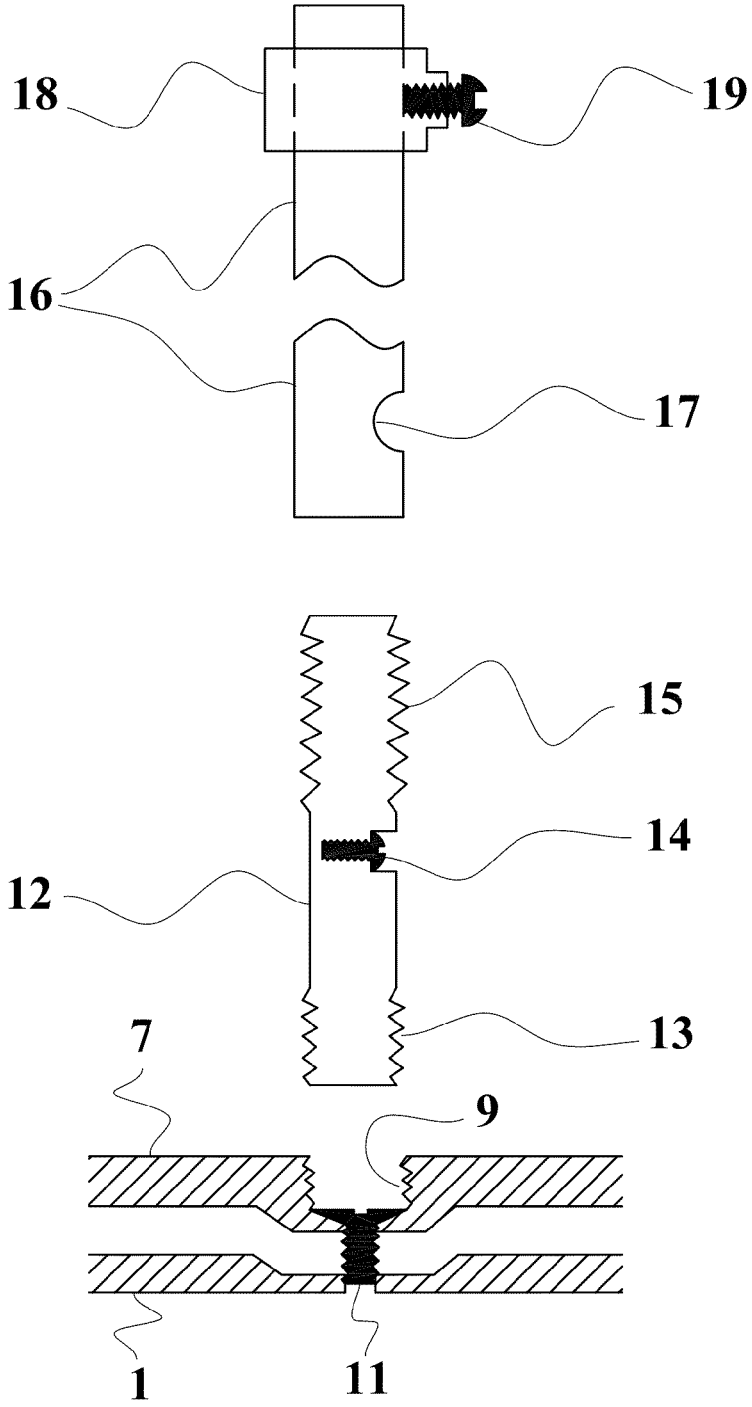
FIG. 14 is an exploded detail sectional view of the small spindle combined with the turntable of the preferred embodiment of the invention, drawn along lines 7-7 of FIG. 11.
Figure 15:
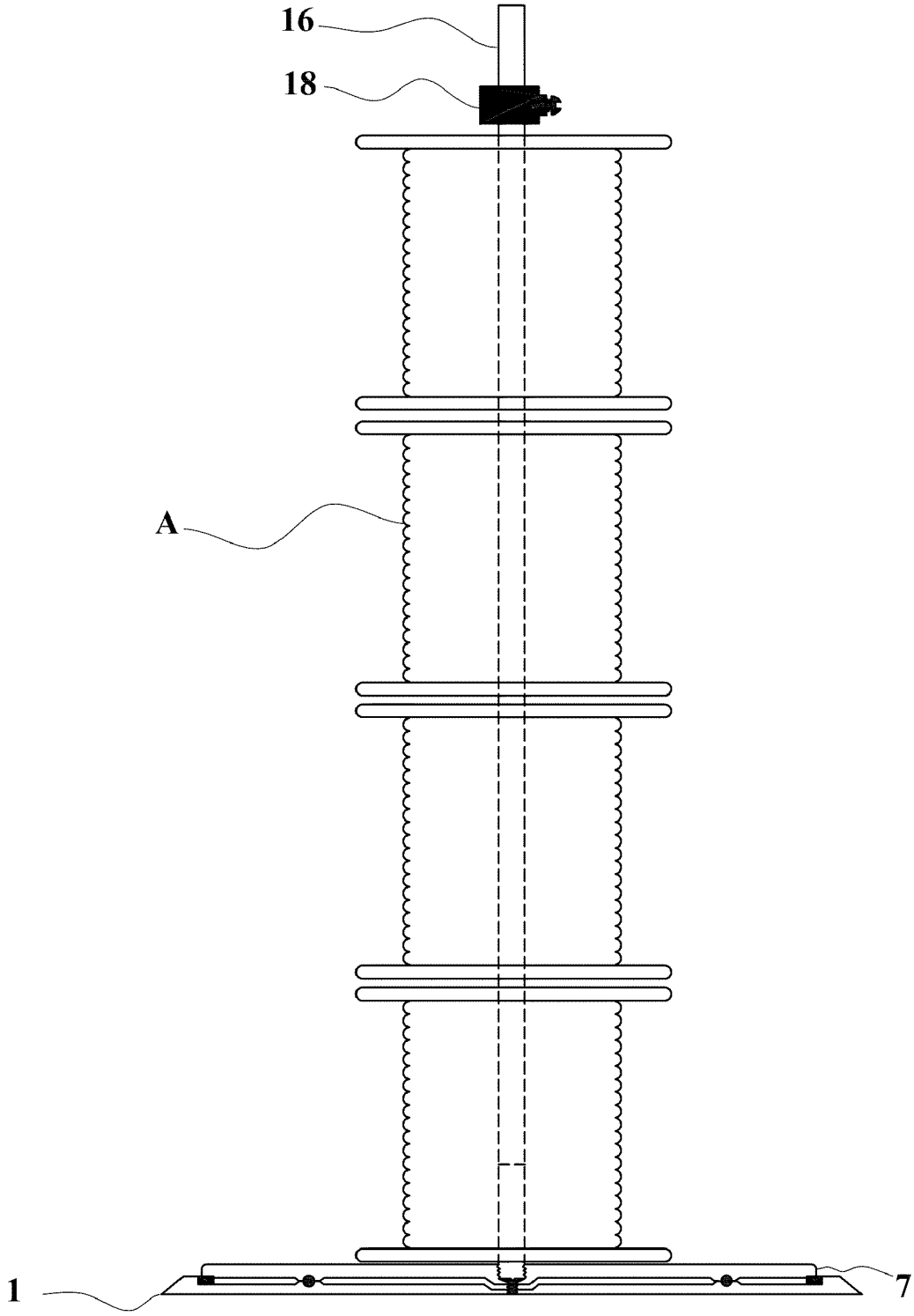
FIG. 15 is a sectional view of the small spindle combined with the turntable of the preferred embodiment of the invention, showing it holding four small spools, drawn along lines 7-7 of FIG. 11.

FIG. 10 is a front elevational view of the small spindle of the preferred embodiment of the invention, showing the small outer spindle 16, with first transverse hole 17, spool retainer 18 to prevent spools from sliding up and off the spindle, and third set screw 19 to removably retain the spool retainer on the small outer spindle. When the first set screw on the inner spindle is screwed all the way in, the small outer spindle may be removed from the inner spindle. But when the first set screw is screwed part way out, so that its head fills the first transverse hole, the small outer spindle is fixed in place on the inner spindle. (The first set screw may be screwed out by placing a screw driver through the first transverse hole.) FIG. 11 is a top plan view of the small spindle of the preferred embodiment of the invention. FIG. 12 is a sectional view of the small spindle of the preferred embodiment of the invention, drawn along lines 7-7 of FIG. 11. FIG. 13 is a detail sectional view of the small spindle combined with the turntable of the preferred embodiment of the invention, drawn along lines 7-7 of FIG. 11. FIG. 14 is an exploded detail sectional view of the small spindle combined with the turntable of the preferred embodiment of the invention, drawn along lines 7-7 of FIG. 11. Note that when first set screw 14 is turned all the way in, the inner spindle 12 has a smooth outer surface that will not hinder the small outer spindle from being placed down around it. FIG. 15 is a sectional view of the small spindle combined with the turntable of the preferred embodiment of the invention, showing it holding four small spools A, drawn along lines 7-7 of FIG. 11. The small outer spindle can be made from one-half inch electrical metallic tubing ("EMT") or other suitable material.

Figure 16:
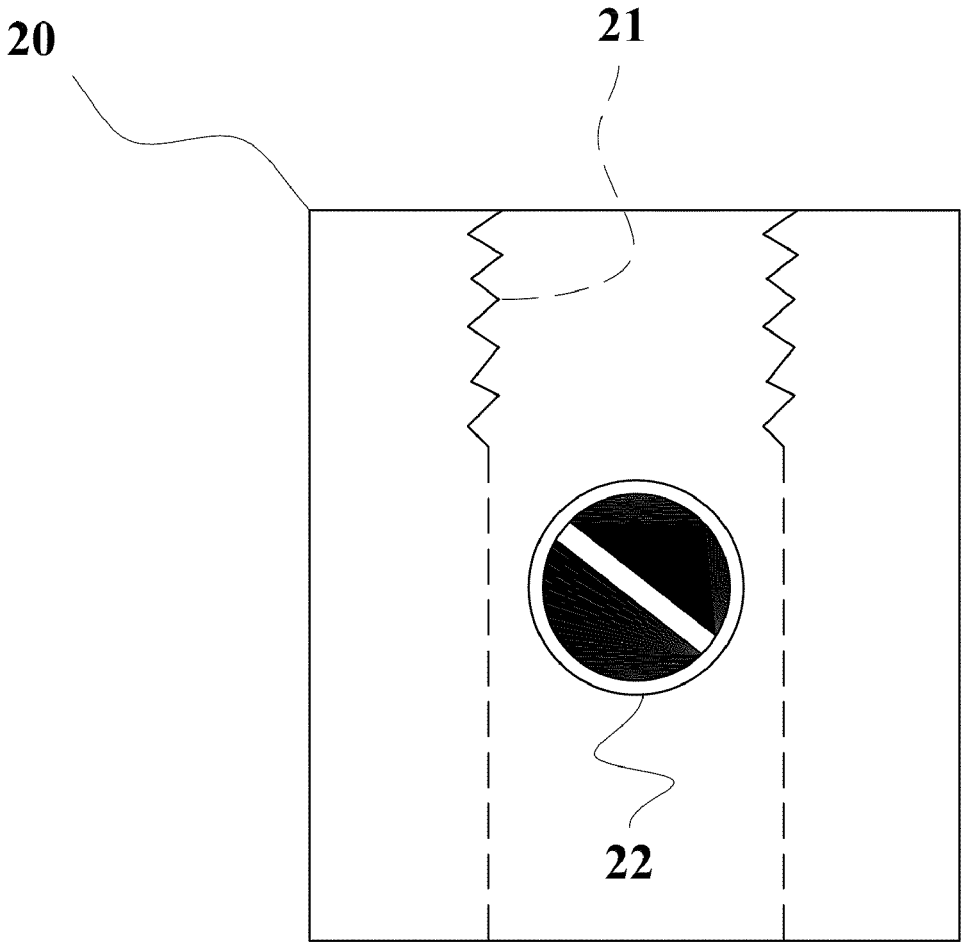
FIG. 16 is a front elevational view of the attachment connector of the preferred embodiment of the invention.
Figure 17:
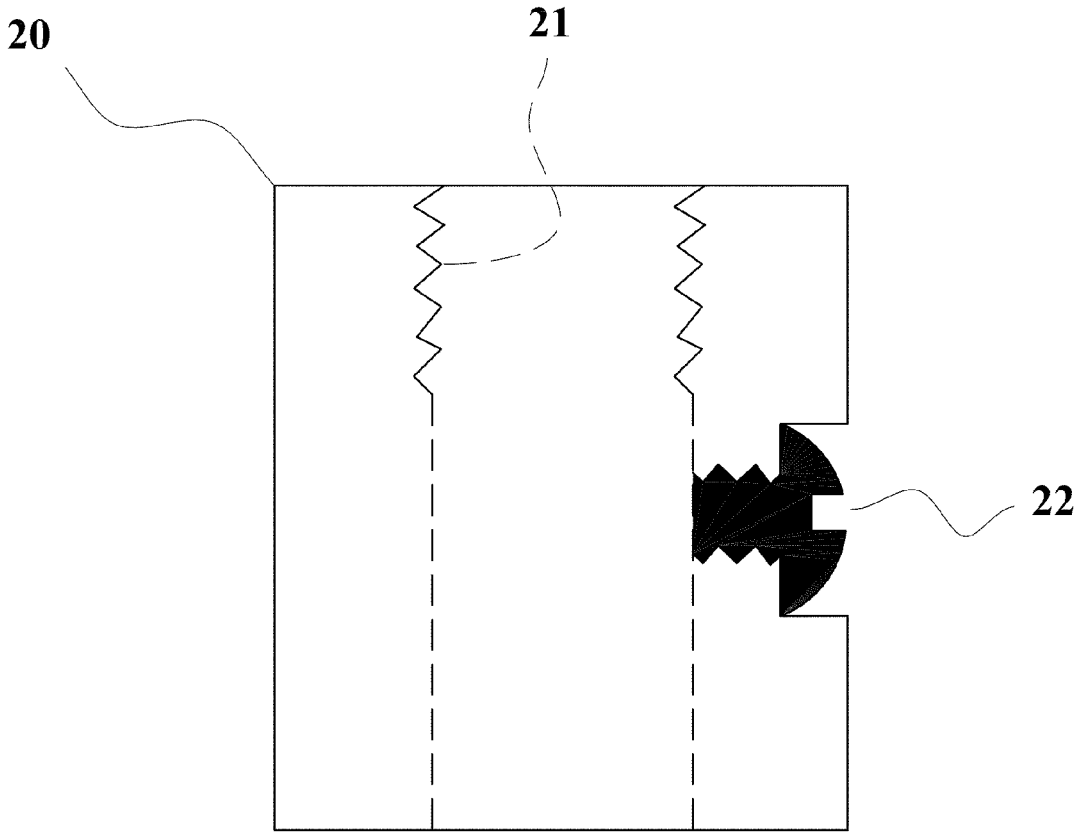
FIG. 17 is a left side elevational view of the attachment connector of the preferred embodiment of the invention.
Figure 18:
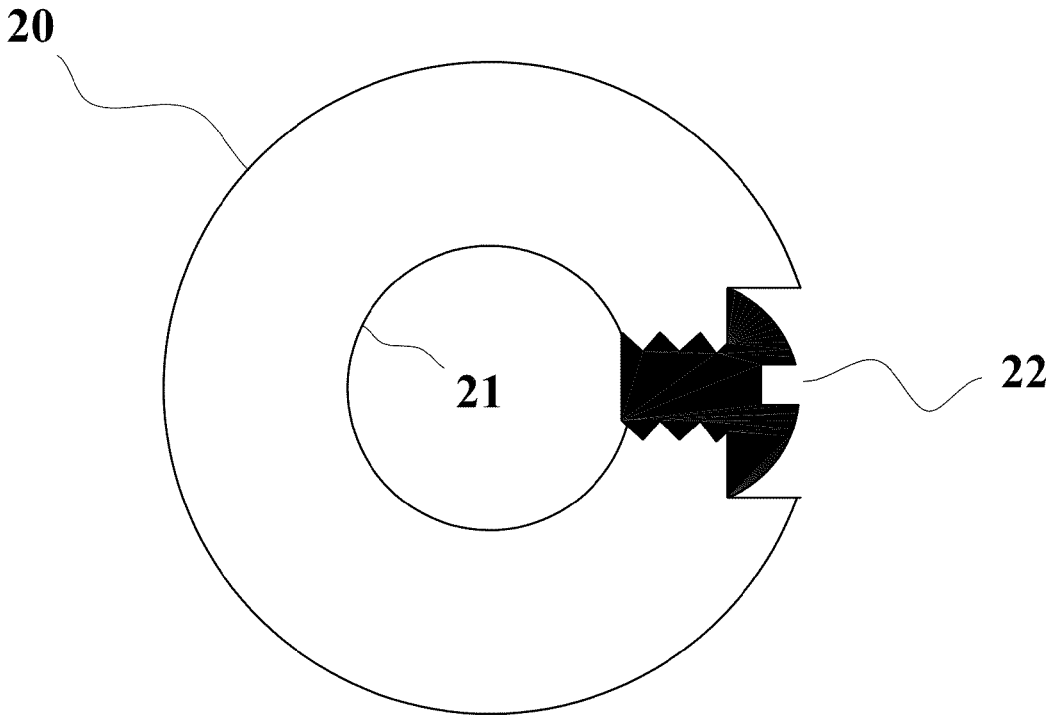
FIG. 18 is a top plan view of the attachment connector of the preferred embodiment of the invention.

FIG. 16 is a front elevational view of the attachment connector 20 of the preferred embodiment of the invention, which is used to attach both the large spindle and the clamping assembly to the turntable, but in different manners. The attachment connector has inner threads 21 that can engage the outer threads on the upper part of the inner spindle, and the second set screw 22. FIG. 17 is a left side elevational view of the attachment connector of the preferred embodiment of the invention. Note that when second set screw 22 is turned all the way in, the attachment connector 20 has a smooth outer surface that will not hinder the large outer spindle 23 from being placed down around it. FIG. 18 is a top plan view of the attachment connector of the preferred embodiment of the invention.

Figure 19:
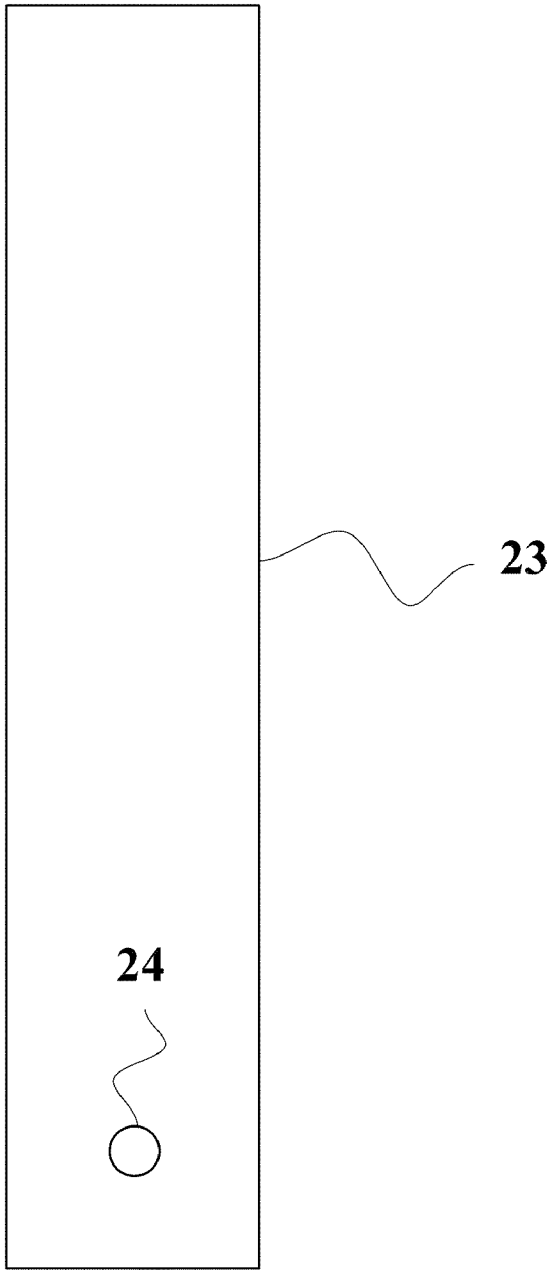
FIG. 19 is a front elevational view of the large spindle of the preferred embodiment of the invention.
Figure 20:
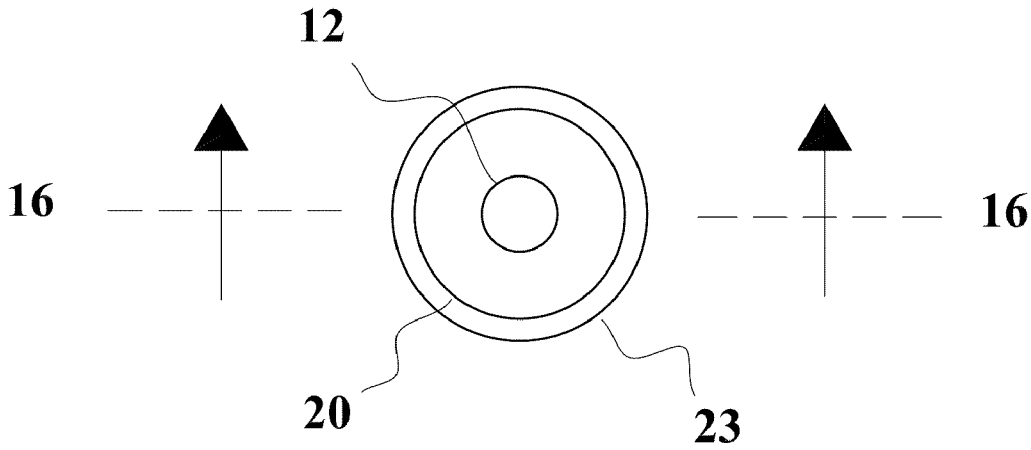
FIG. 20 is a top plan view of the large spindle of the preferred embodiment of the invention.
Figure 21:
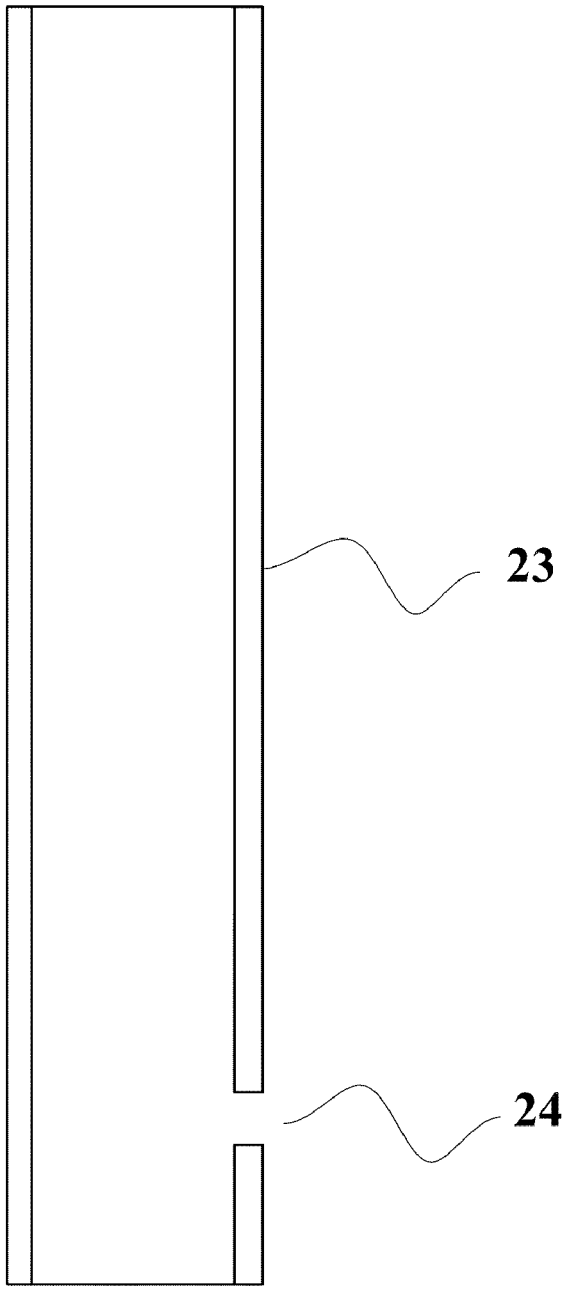
FIG. 21 is a sectional view of the large spindle of the preferred embodiment of the invention, drawn along lines 16-16 of FIG. 20.
Figure 22:
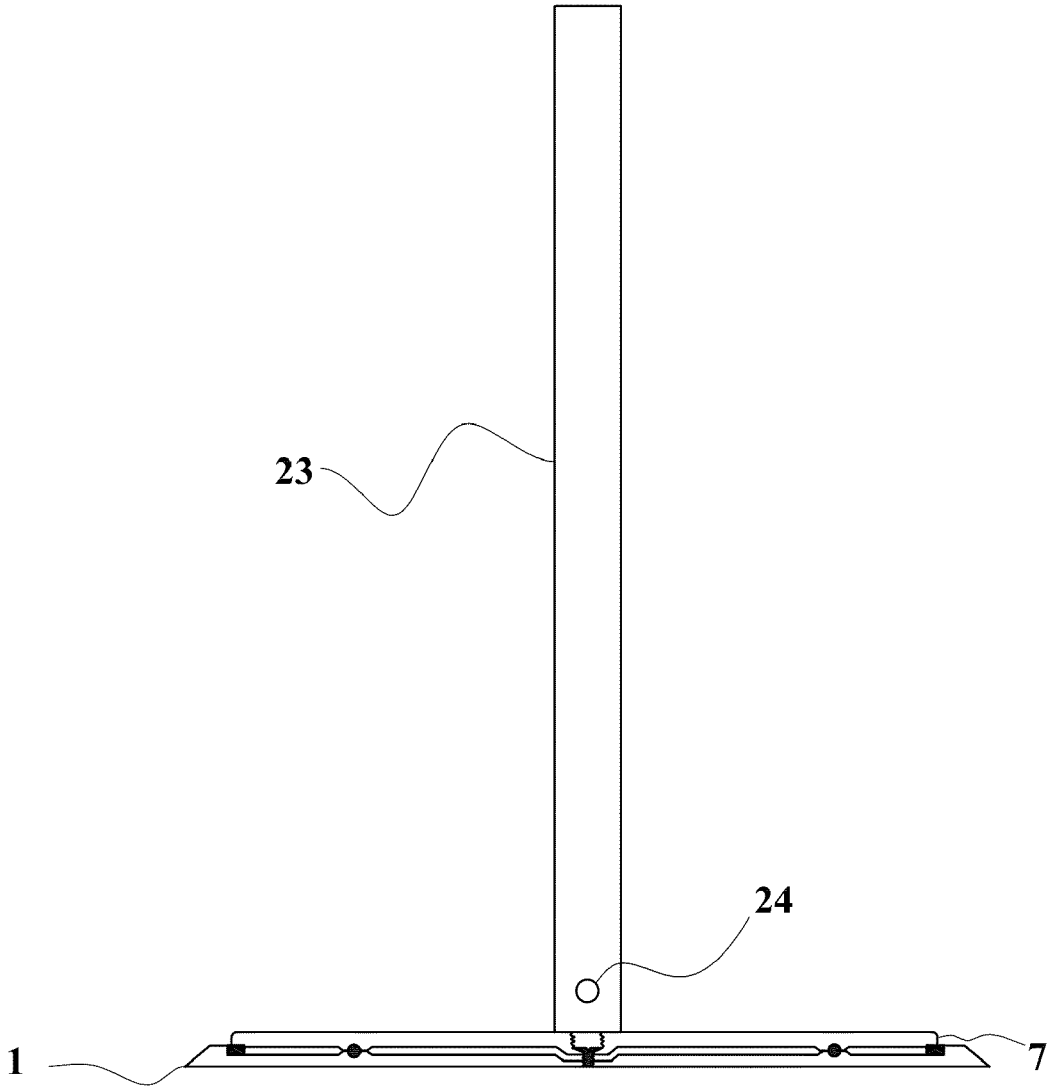
FIG. 22 is a front elevational view of the large spindle combined with the turntable of the preferred embodiment of the invention.

FIG. 19 is a front elevational view of the large spindle of the preferred embodiment of the invention, showing the large outer spindle 23, with second transverse hole 24. When the second set screw on the attachment connector is screwed all the way in, the large outer spindle may be removed from the attachment connector and the turntable. But when the second set screw is screwed part way out, so that its head fills the second transverse hole, the large outer spindle is fixed in place on the attachment member to the turntable (when the attachment member has been screwed onto the inner spindle). (The second set screw may be screwed out by placing a screw driver through the second transverse hole.) FIG. 20 is a top plan view of the large spindle of the preferred embodiment of the invention, showing the large outer spindle 23 retained on the attachment connector 20 retained on the inner spindle 12. FIG. 21 is a sectional view of the large spindle of the preferred embodiment of the invention, drawn along lines 16-16 of FIG. 20. FIG. 22 is a front elevational view of the large spindle combined with the turntable of the preferred embodiment of the invention.

Figure 23:
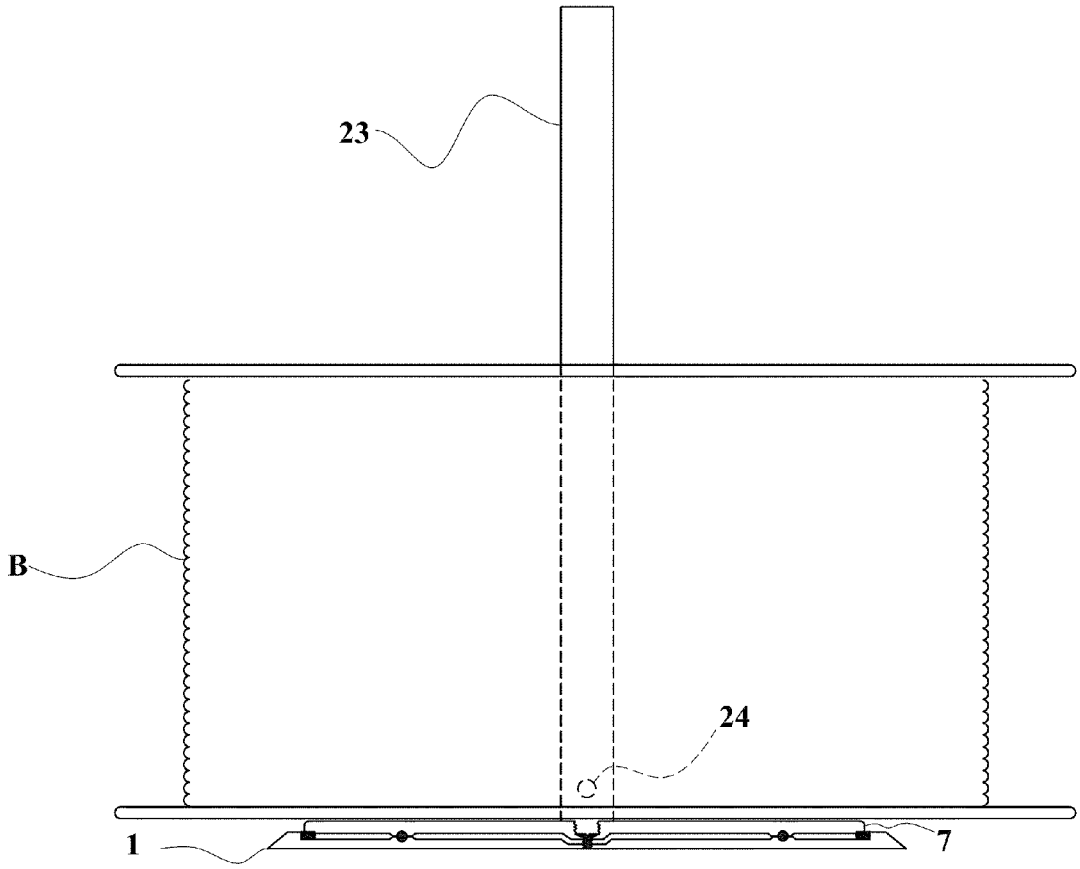
FIG. 23 is a sectional view of the large spindle combined with the turntable of the preferred embodiment of the invention, showing it holding a large reel, drawn along lines 16-16 of FIG. 20.

FIG. 23 is a sectional view of the large spindle combined with the turntable of the preferred embodiment of the invention, showing it holding a large reel B, drawn along lines 16-16 of FIG. 20. The large outer spindle can be made from one and one-quarter inch electrical metallic tubing ("EMT") or other suitable material.

Figure 24:
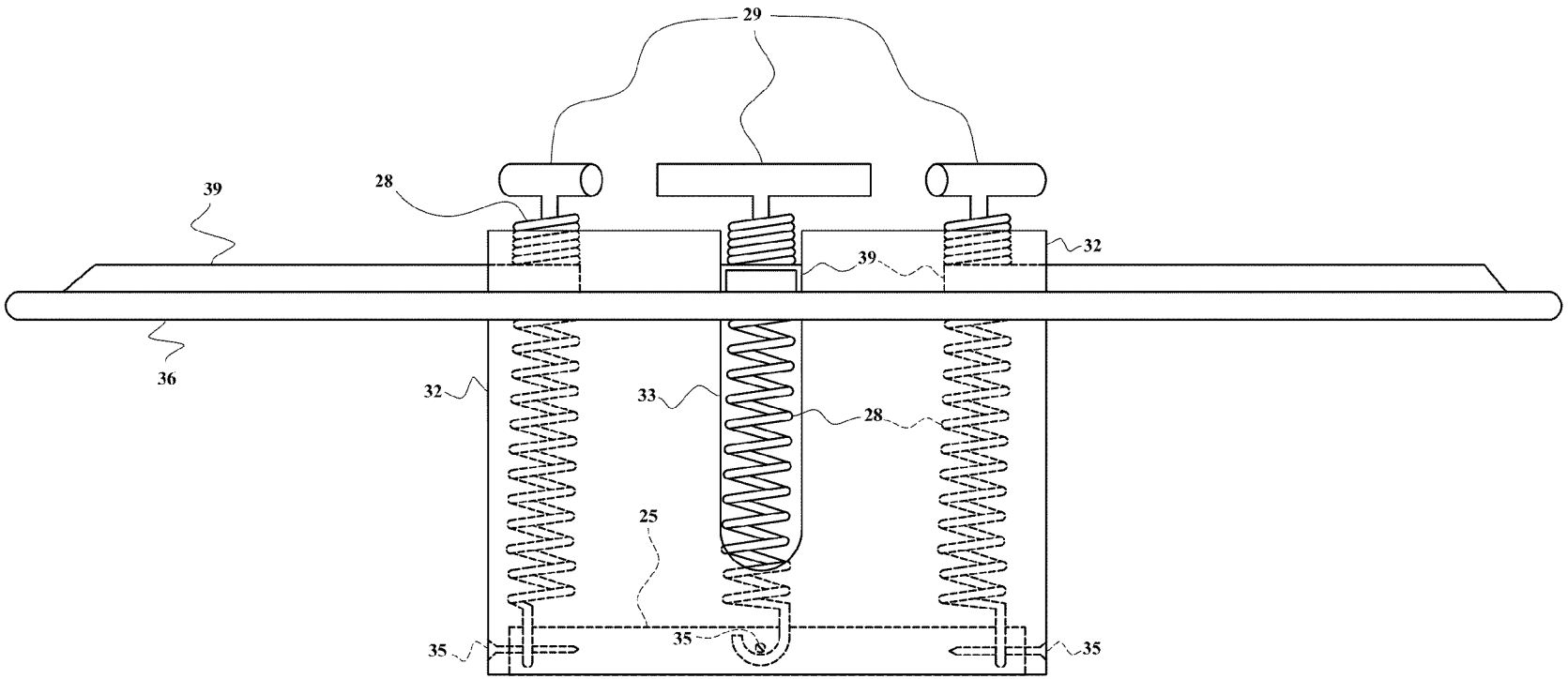
FIG. 24 is a front elevational view of the clamping assembly of the preferred embodiment of the invention.
Figure 25:
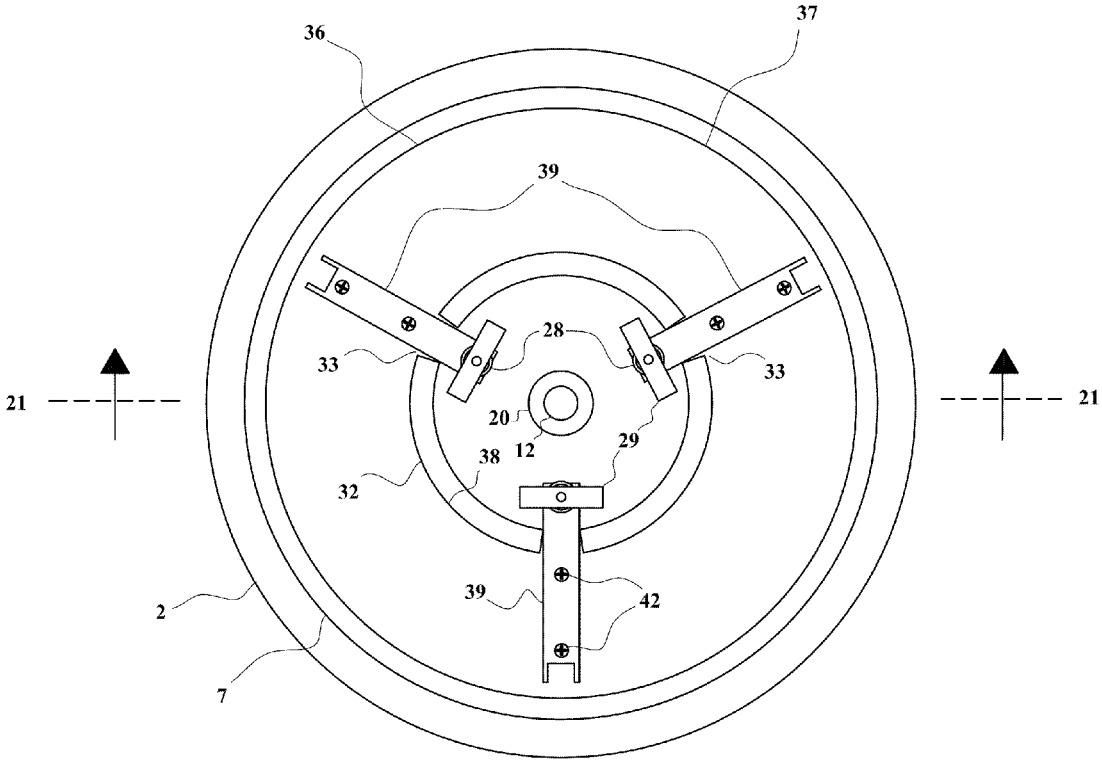
FIG. 25 is a top plan view of the clamping assembly of the preferred embodiment of the invention combined with the turntable.

FIG. 24 is a front elevational view of the clamping assembly of the preferred embodiment of the invention, showing the hub 32 (around which a coil of cable may be placed), pressure plate 36 that can push down on a coil to hold it in place, springs 28 (preferably three) that cause the pressure plate to push down, T-shaped handles 29 for each spring, spring holds 39 attached to the pressure plate for each spring, and slots 33 in the hub for each spring through which the inner ends of the spring holds can pass. FIG. 25 is a top plan view of the clamping assembly of the preferred embodiment of the invention, combined with the turntable, showing the rounded inner edge 37 and rounded outer edge 38 of the pressure plate, and the bolts 42 that retain the spring holds on the pressure plate.

Figure 26:
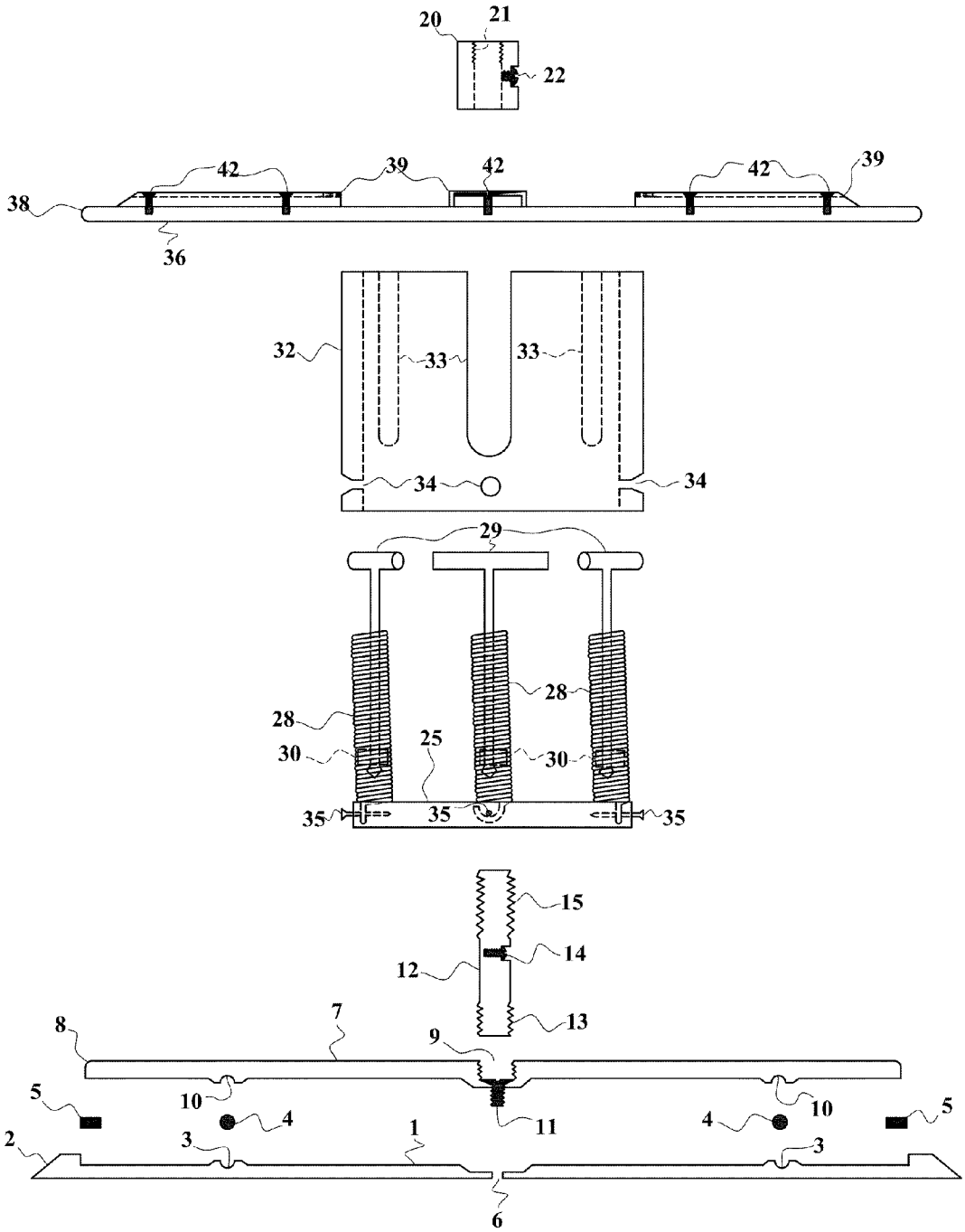
FIG. 26 is an exploded sectional view of the clamping assembly of the preferred embodiment of the invention, combined with the turntable, drawn along lines 21-21 of FIG. 25.

FIG. 26 is an exploded sectional view of the clamping assembly of the preferred embodiment of the invention, combined with the turntable, drawn along lines 21-21 of FIG. 25. The springs 28 are attached to the perimeter of the hub base 25. This allows the springs to rotate to either side of the slots 27 (shown in FIG. 38), while keeping the springs close to the side of the coil hub 32, and accessible for use.

Figure 27:
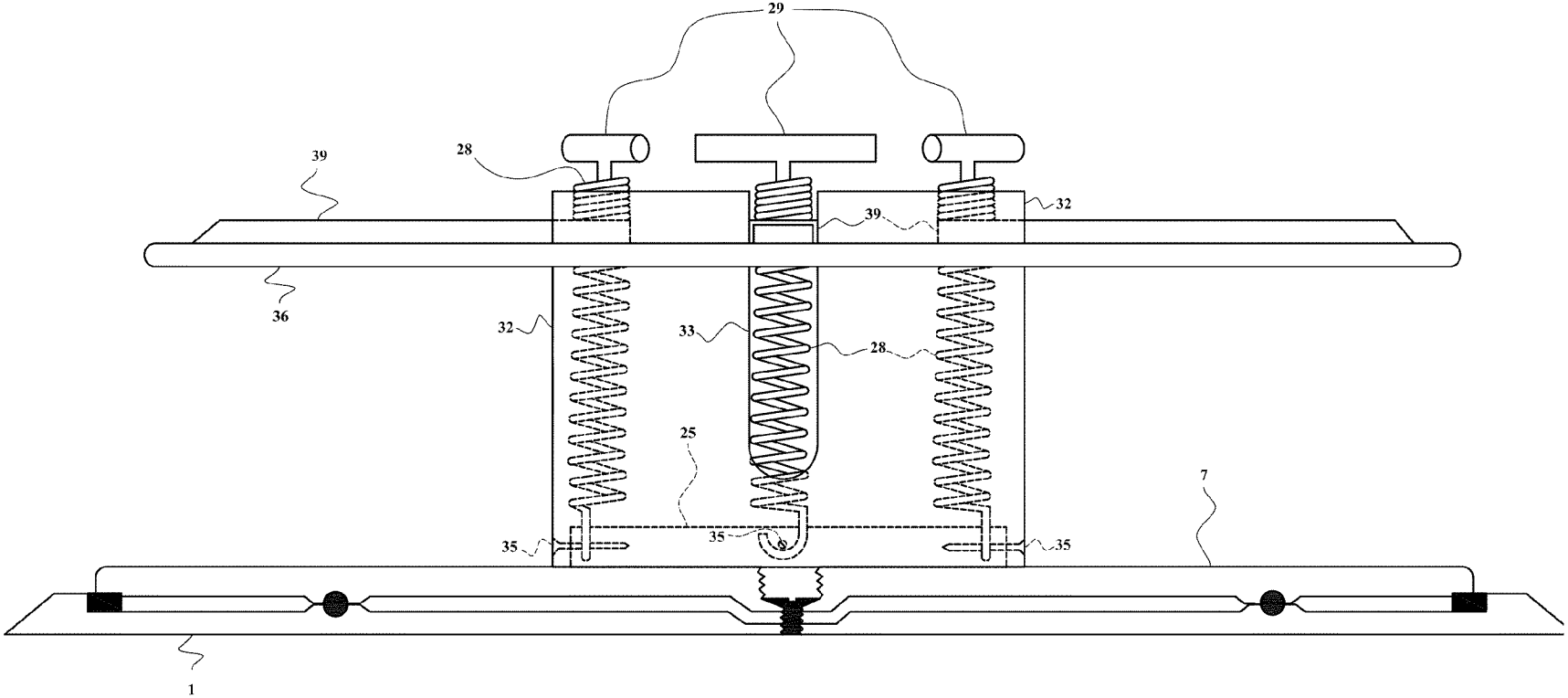
FIG. 27 is a front elevational view of the clamping assembly combined with the turntable of the preferred embodiment of the invention.
Figure 28:
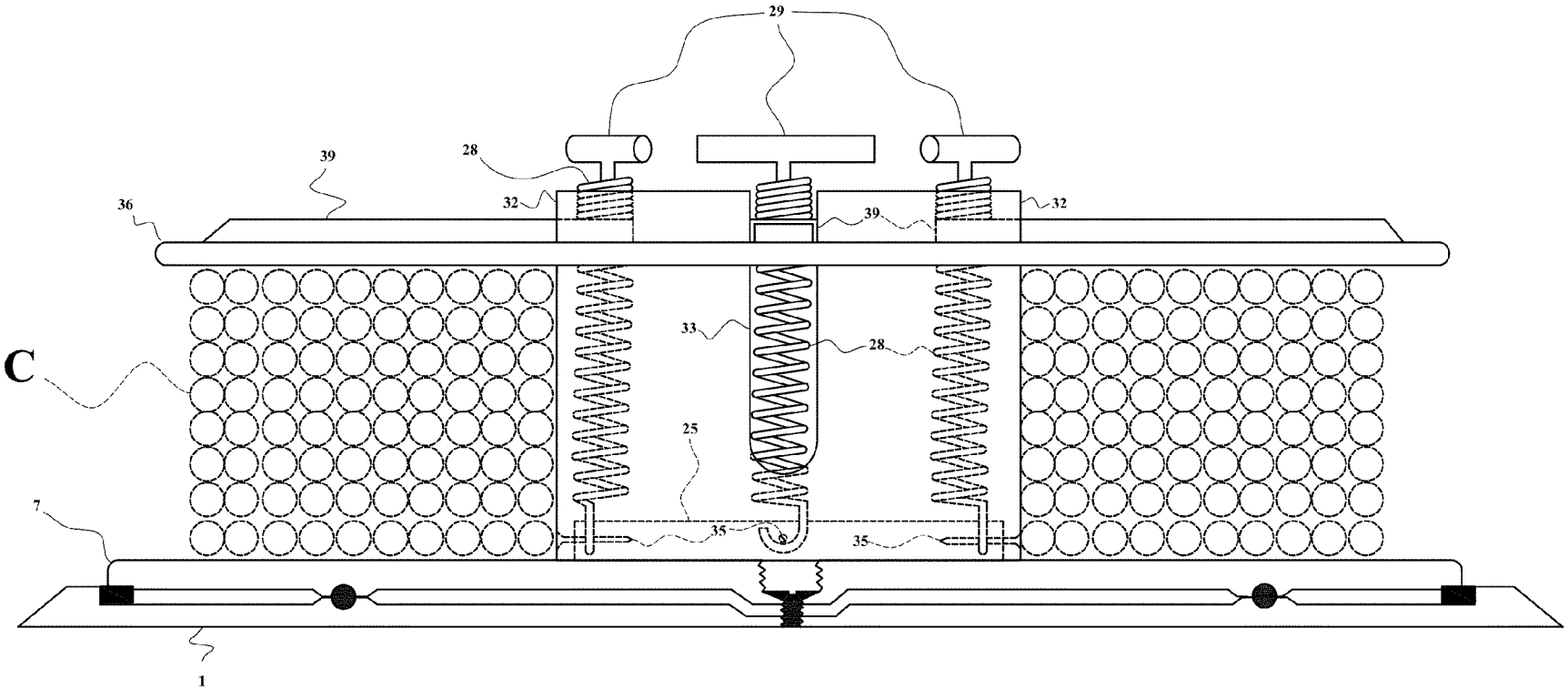
FIG. 28 is a sectional view of the clamping assembly combined with the turntable of the preferred embodiment of the invention, showing it holding a coil of cable, drawn along lines 21-21 of FIG. 25.
Figure 29:
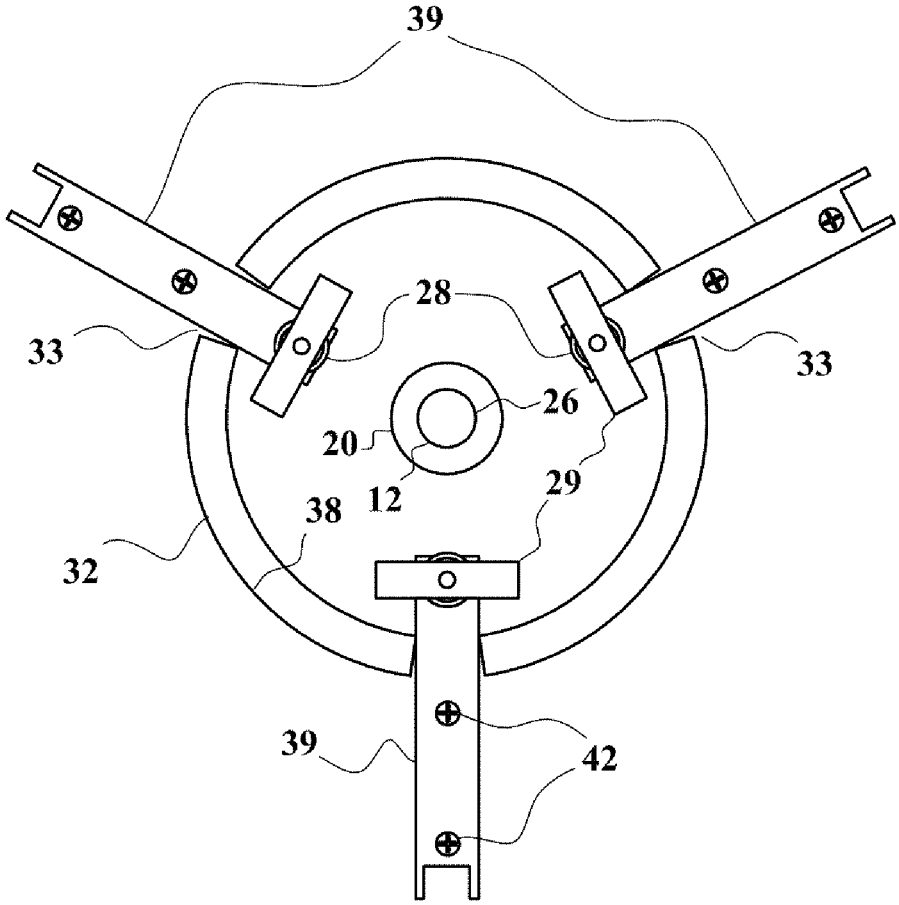
FIG. 29 is a detail top view of the central part of the clamping assembly.
Figure 30:
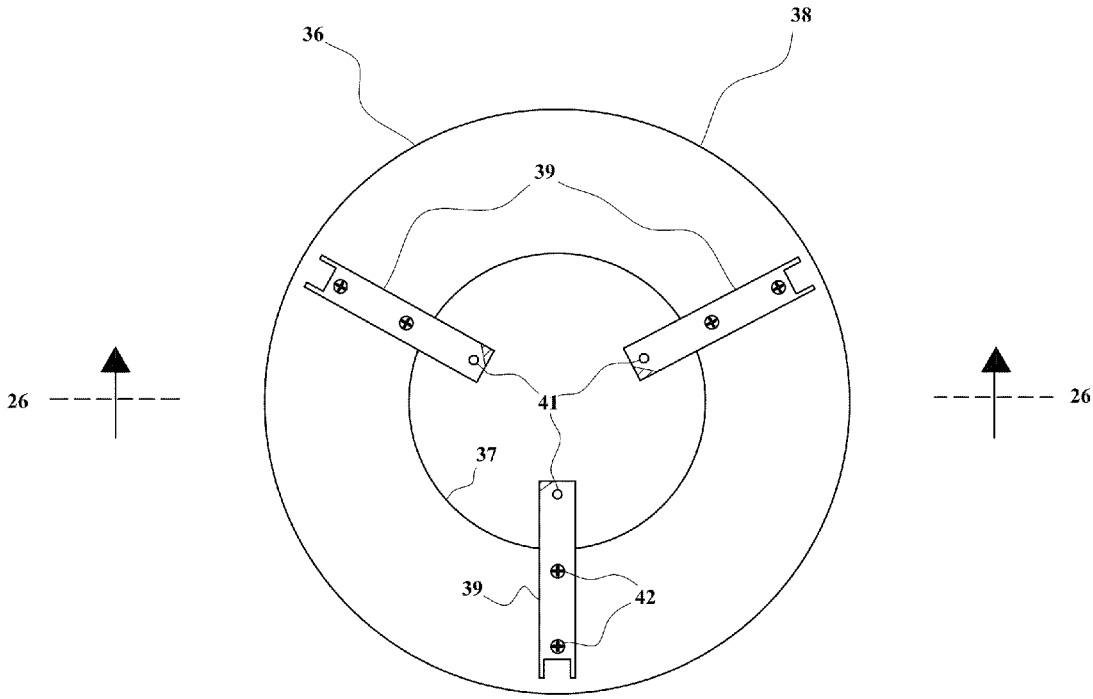
FIG. 30 is a detail top view of the pressure plate of the clamping assembly.
Figure 31:
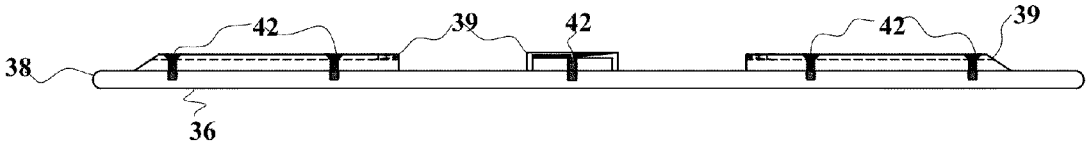
FIG. 31 is a sectional view of the pressure plate of the clamping assembly, drawn along lines 26-26 of FIG. 30.

FIG. 27 is a front elevational view of the clamping assembly combined with the turntable of the preferred embodiment of the invention. FIG. 28 is a sectional view of the clamping assembly combined with the turntable of the preferred embodiment of the invention, showing it holding a coil of cable, drawn along lines 21-21 of FIG. 25. FIG. 29 is a detail top view of the central part of the clamping assembly. FIG. 30 is a detail top view of the pressure plate of the clamping assembly. The T-shaped spring handles 29 extend from springs 28. When a handle is pulled up to stretch the spring, the handle prevents the user from getting his or her fingers pinched on top of the coil hub 32, the spring holder 39 should fail to hold the spring. FIG. 31 is a sectional view of the pressure plate of the clamping assembly, drawn along lines 26-26 of FIG. 30.

Figure 32:
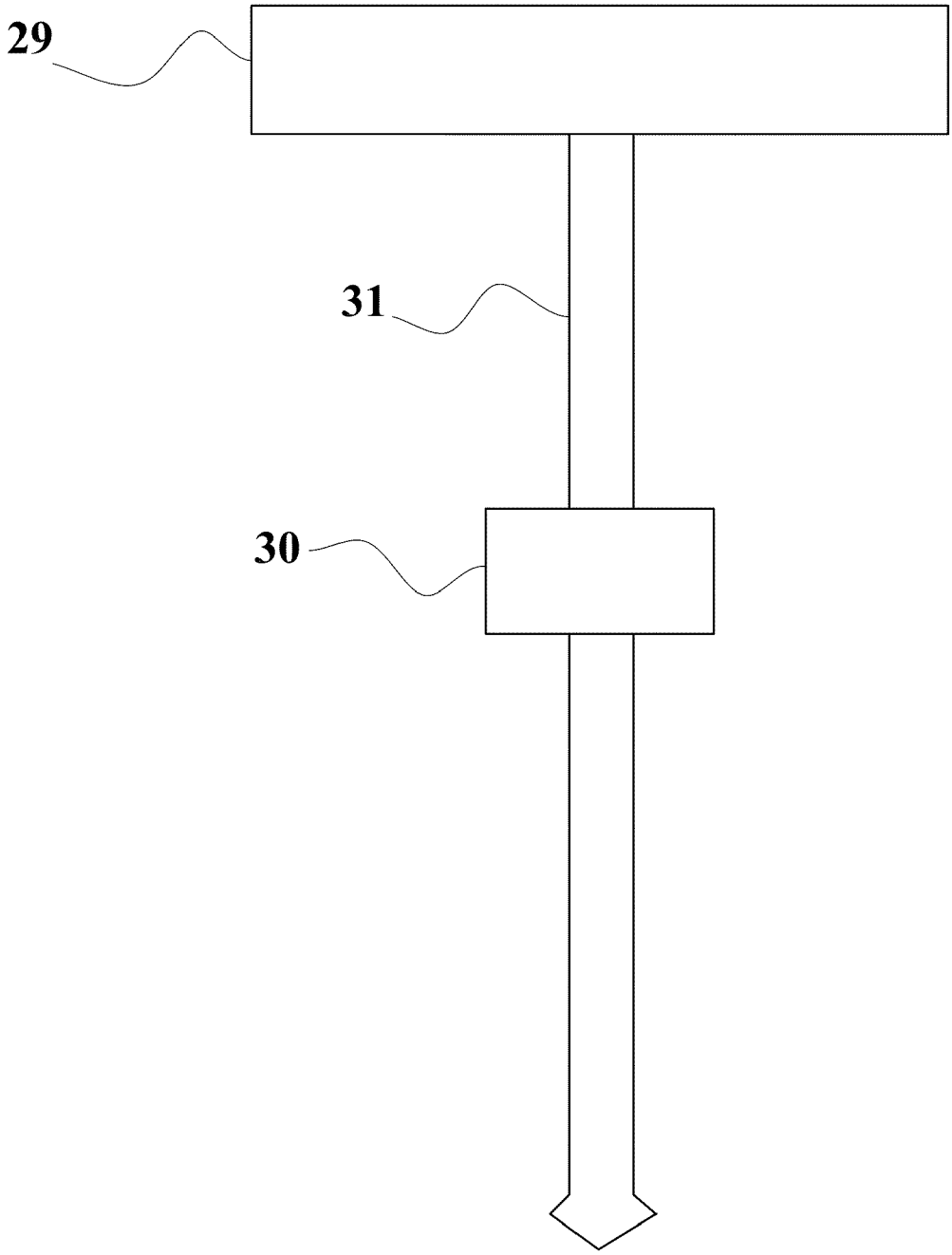
FIG. 32 is a front detail view of one of the spring handles of the clamping assembly.
Figure 33:
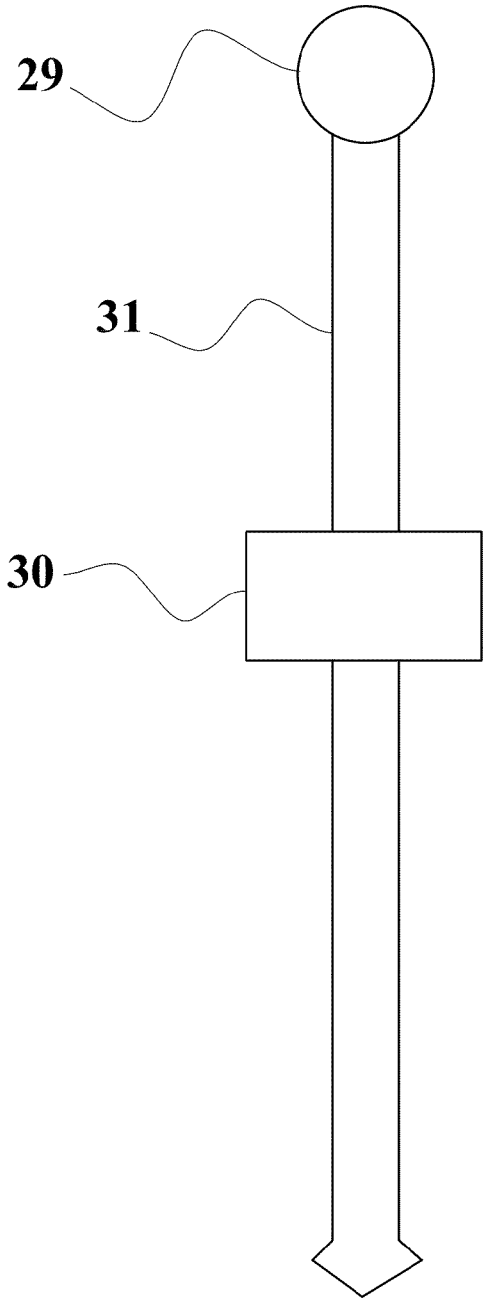
FIG. 33 is a side detail view of one of the spring handles of the clamping assembly.
Figure 34:
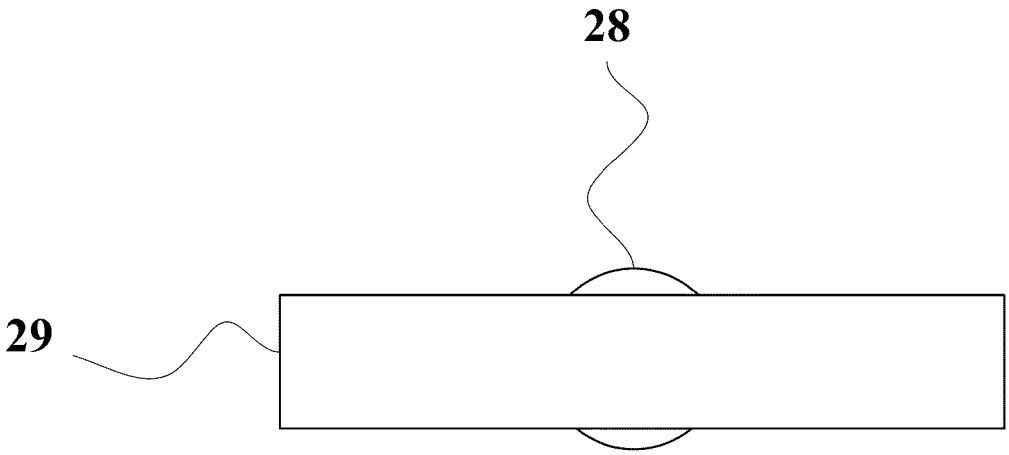
FIG. 34 is top detail view of one the spring handles of the clamping assembly.
Figure 35:
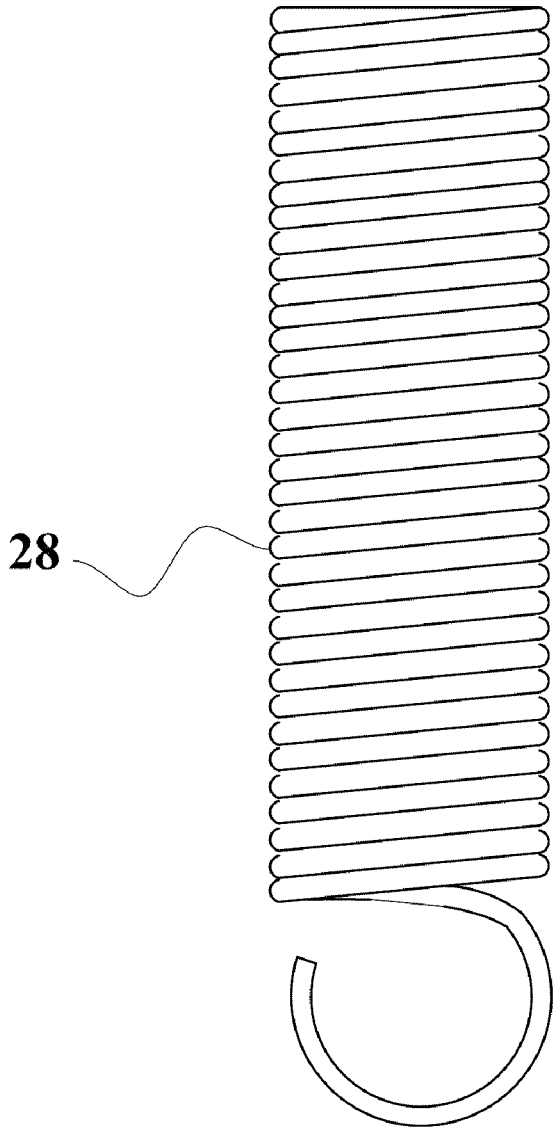
FIG. 35 is a front detail view of one of the springs in the clamping assembly.
Figure 36:
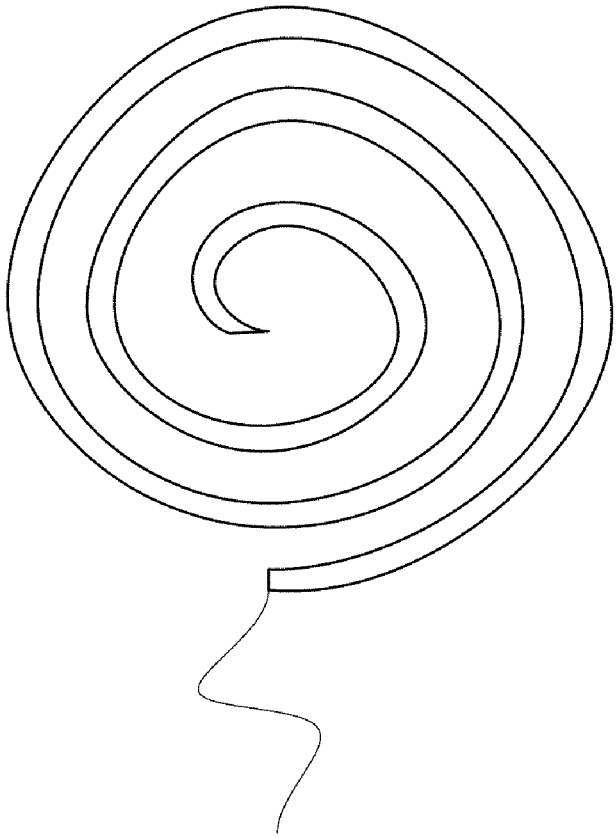
FIG. 36 is a top view of one of the springs in the clamping assembly.
Figure 37:
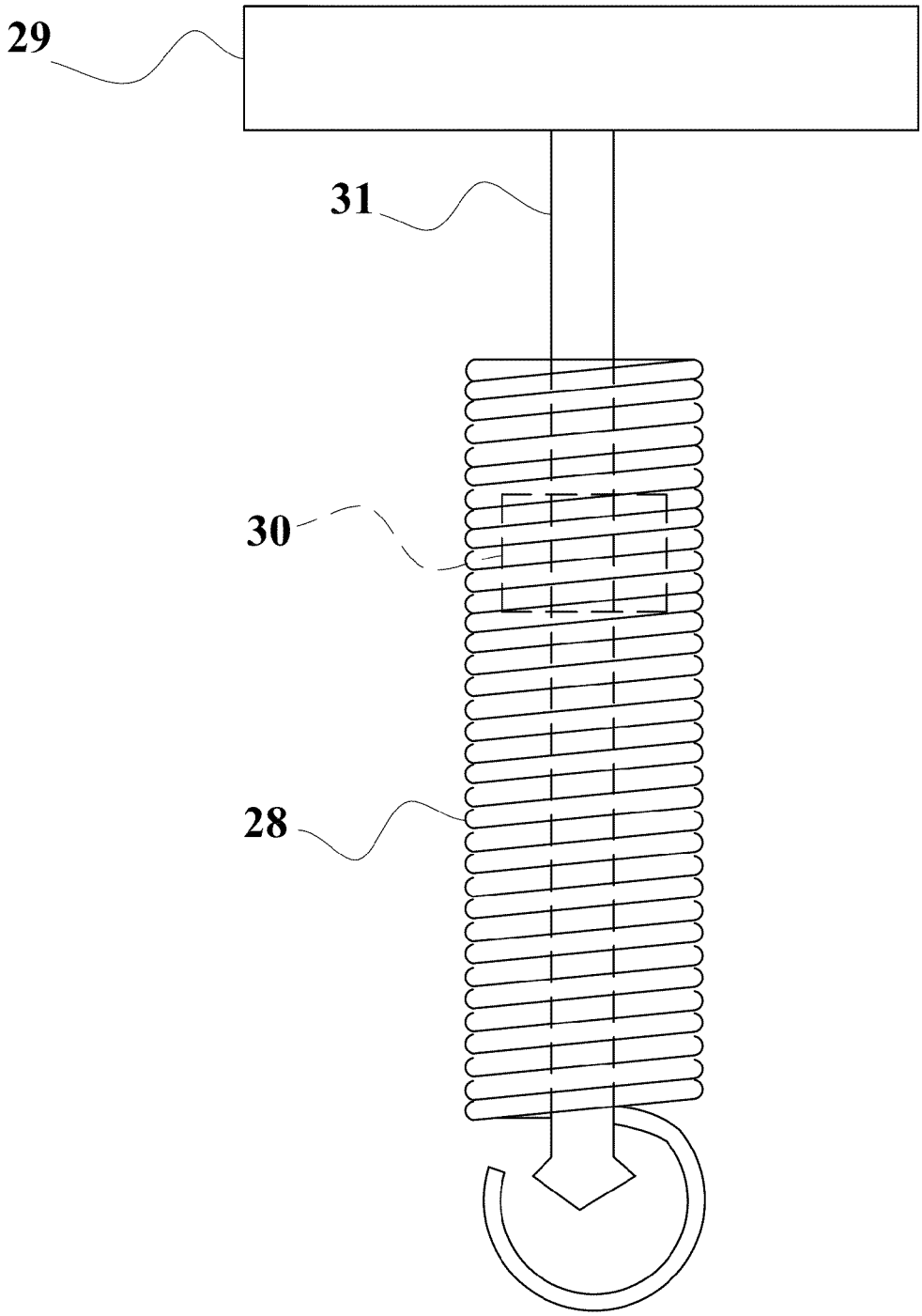
FIG. 37 is a front detail view of a spring and spring handle combined in the clamping assembly.
Figure 38:
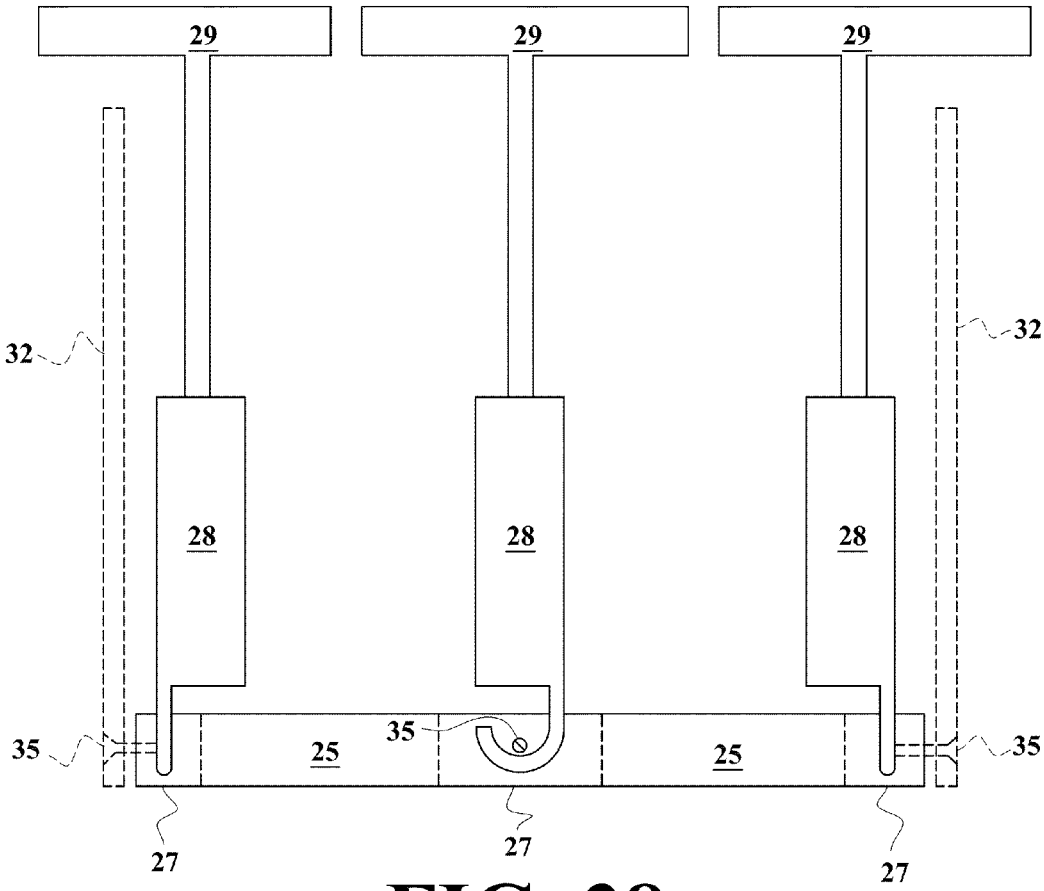
FIG. 38 is front detail view showing the connection of the springs to the hub base in the clamping assembly.
Figure 39:
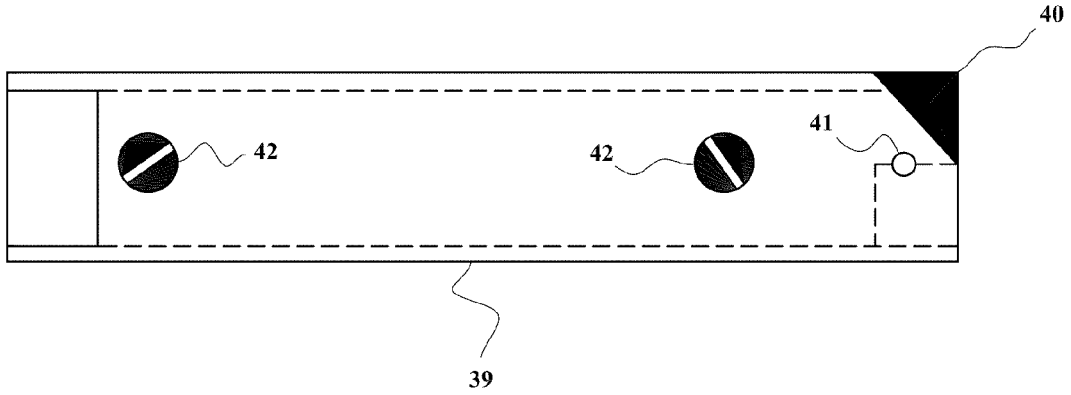
FIG. 39 is a top detail view of one of the spring holds in the clamping assembly.
Figure 40:
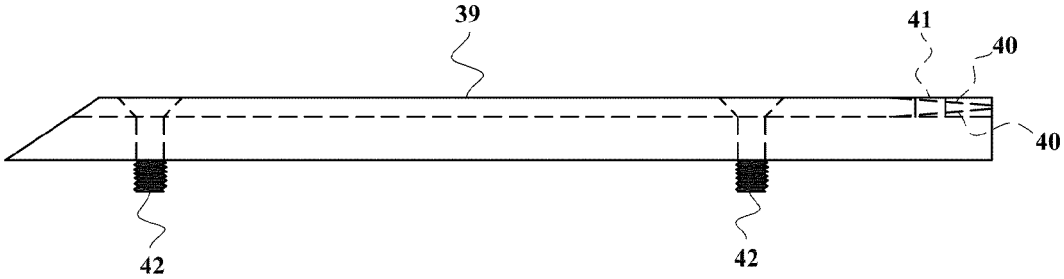
FIG. 40 is a side detail view of one of the spring holds in the clamping assembly.
Figure 41:
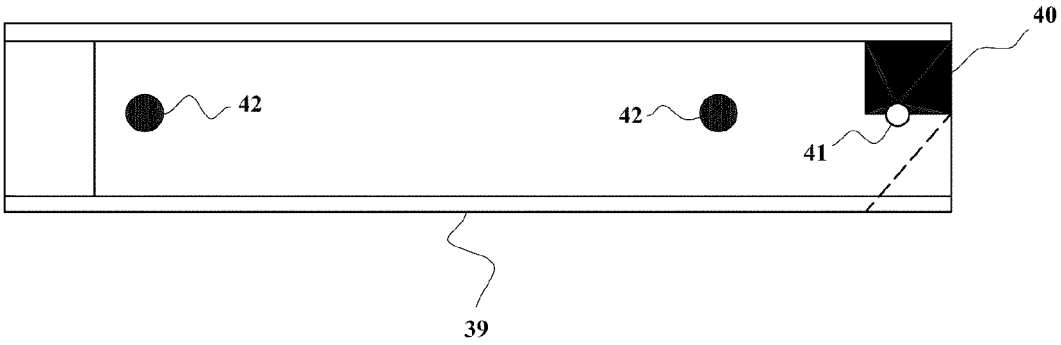
FIG. 41 is a bottom detail view of one of the spring holds in the clamping assembly.
Figure 42:
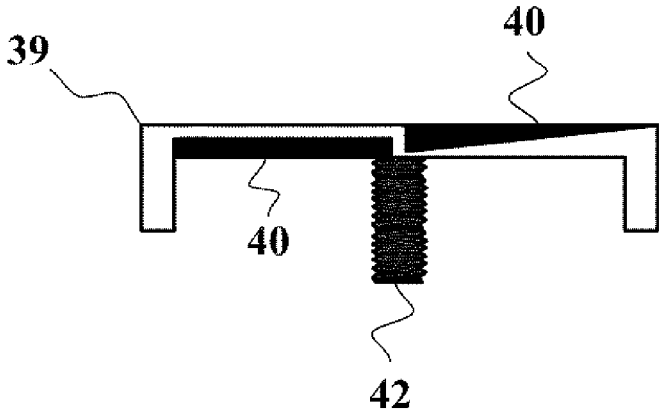
FIG. 42 is a detail elevational view of the inner end of one of the spring holds in the clamping assembly.

FIG. 32 is a front detail view of one of the spring handles of the clamping assembly. FIG. 33 is a side detail view of one of the spring handles of the clamping assembly. FIG. 34 is top detail view of one the spring handles of the clamping assembly. FIG. 35 is a front detail view of one of the springs in the clamping assembly. FIG. 36 is a top view of one of the springs in the clamping assembly. FIG. 37 is a front detail view of a spring and spring handle combined in the clamping assembly. The bottoms of the springs are retained on screws 35 in slots 27 between flattened areas on the circumference of the hub base and the wall of the hub 32. The bottoms of the springs can rotate on the screws within the slots. FIG. 38 is front detail view showing the connection of the springs to the hub base in the clamping assembly. FIG. 39 is a top detail view of one of the spring holds in the clamping assembly. FIG. 40 is a side detail view of one of the spring holds in the clamping assembly. FIG. 41 is a bottom detail view of one of the spring holds in the clamping assembly. FIG. 42 is a detail elevational view of the inner end of one of the spring holds in the clamping assembly. Each spring hold 39 has a receiving end 40 that has tapered surfaces on the top and bottom that will allow the coils of the spring to slip onto the holder without resistance when its T-shaped handle is pulled up to stretch the spring. After a T-shaped handle is pulled up and the coiled spring 28 is stretched and slipped onto the spring hold 39, the T-shaped handle is pushed down, pushing its shaft 31 through the lock-in hole 41. The slip bushing 30 will drop and be aligned with the lock-in hole, allowing the shaft of the T-shaped handle to pass through both the bushing and the lock-in hole. The spring is thus locked onto the spring hold, and is applying pressure to the top of a coil of cable through the pressure plate 36.

It is to be understood that the present invention is not limited to the sole embodiment described above, but encompasses any and all embodiments within the scope of the following claims.

I claim:

1. A dispenser, comprising:

a turntable;

a turntable base on which the turntable is retained, with a side that slopes outward from an upper edge of the base to a lower surface of the base;

an inner spindle with a bottom end that can be retained in the turntable, and a top end that extends upward from the turntable when the bottom end is so retained;

a hub base with a hole through which the inner spindle can pass;

one or more springs having a first end attached to the hub base, and a second end that can be pulled by a handle; and a pressure plate having a central opening, with one or more spring holds that extend into the central opening and can engage coils of the springs between a first ends and a second ends, to pull the pressure plate toward the base.

2. The dispenser according to claim 1, further comprising:

an attachment connector, having an axial cavity with internal screw threads that can engage external screw threads on the inner spindle, to retain the hub base on the turntable; and a cylindrical hub attached to the hub base, with slots within which the spring holds can move.

3. The dispenser according to claim 1, wherein the hub base is generally circular, with flattened areas on its circumference, at which the springs are attached.

4. The dispenser according to claim 1, wherein for at least one of the springs there is:

a shaft that extends from the handle, with the shaft having a widened portion at an end opposite from the handle;

a bushing having a central hole through which the shaft passes, with the bushing being retained on the shaft and within the spring, and with the bushing being able to move between the widened portion of the shaft and the top of the spring;

wherein when the handle is pulled away from the base, the widened portion of the shaft engages the bushing, the bushing pulls the top of the spring, and the spring is stretched so that coils of the spring can be moved over the spring hold; and wherein there is a hole in the spring hold, and when a coil of the spring is engaged by the spring hold around the hole, the handle can be pushed down, moving the shaft down through the holes in the bushing and spring hold, thus locking the spring in place on the spring hold.

5. The dispenser according to claim 1, wherein at least one of the spring holds has at least one tapered surface that will enable the coils of the springs to more easily slide over the spring hold to be engaged by the spring hold.

6. The dispenser according to claim 1, wherein the pressure plate and its central opening are both circular, there are a plurality of springs and spring holds, the number of springs and spring holds is equal, the springs are positioned at equal distances around the hub base, and the spring holds are positioned at equal distances around the central opening of the pressure plate.

7. The dispenser according to claim 1, further comprising:

a first screw hole in the inner spindle, with internal screw threads;

a first setscrew having a head and a shaft with external screw threads that can engage the internal screw threads in the first screw hole;

a small outer spindle having a hollow interior bounded by a cylindrical inner surface that can fit over a cylindrical outer surface of the inner spindle, said small outer spindle having a first transverse hole that can be occupied by the head of the first set screw when the attachment member is rotated in a first direction, causing the head to move outward into the first transverse hole, to retain the small outer spindle on the inner spindle, with said small outer spindle being removable from the inner spindle when the first setscrew is rotated in a second direction opposite to the first direction to cause its head to move inward and out of the first transverse hole.

8. The dispenser according to claim 7, further comprising:

an attachment connector, having an axial cavity with internal screw threads that can engage external screw threads on the inner spindle;

a second screw hole in a side of the attachment connector, with internal screw threads;

a second setscrew having a head and a shaft with external screw threads that can engage the internal screw threads in the second screw hole; and a large outer spindle having a hollow interior bounded by a cylindrical inner surface that can fit over a cylindrical outer surface of the attachment connector, said large outer spindle having a second transverse hole that can be occupied by the head of the second setscrew when the second setscrew is rotated in a first direction, causing the head to move outward into the second transverse hole, to retain the large outer spindle on the attachment connector, with said large outer spindle being removable from the attachment connector when the second set screw is rotated in a second direction opposite to the first direction to cause the head to move inward and out of the second transverse hole.

9. The dispenser according to claim 1, further comprising:

an attachment connector, having an axial cavity with internal screw threads that can engage external screw threads on the inner spindle;

a second screw hole in a side of the attachment connector, with internal screw threads;

a second setscrew having a head and a shaft with external screw threads that can engage the internal screw threads in the second screw hole; and a large outer spindle having a hollow interior bounded by a cylindrical inner surface that can fit over a cylindrical outer surface of the attachment connector, said large outer spindle having a second transverse hole that can be occupied by the head of the second setscrew when the second setscrew is rotated in a first direction, causing the head to move outward into the second transverse hole, to retain the large outer spindle on the attachment connector, with said large outer spindle being removable from the attachment connector when the second set screw is rotated in a second direction opposite to the first direction to cause the head to move inward and out of the second transverse hole.

* * * * *